US008590614B2

(12) United States Patent
Surjaatmadja et al.

(10) Patent No.: US 8,590,614 B2
(45) Date of Patent: Nov. 26, 2013

(54) HIGH PRESSURE STIMULATION PUMP

(75) Inventors: Jim B. Surjaatmadja, Duncan, OK (US); Stanley V. Stephenson, Duncan, OK (US); Timothy Hunter, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 324 days.

(21) Appl. No.: 13/099,939

(22) Filed: May 3, 2011

(65) Prior Publication Data

US 2012/0279721 A1 Nov. 8, 2012

(51) Int. Cl.
*E21B 43/00* (2006.01)
*F04B 23/06* (2006.01)

(52) U.S. Cl.
USPC ..... 166/105; 417/529; 417/552

(58) Field of Classification Search
USPC ..... 166/105; 417/529, 552
See application file for complete search history.

(56) References Cited

U.S. PATENT DOCUMENTS

| | | | | | |
|---|---|---|---|---|---|
| 419,248 | A | * | 1/1890 | Dow | 417/503 |
| 1,225,817 | A | * | 5/1917 | Howe | 417/504 |
| 1,379,694 | A | * | 5/1921 | Pownall | 417/552 |
| 1,740,967 | A | * | 12/1929 | Buehler, Jr. | 417/529 |
| 1,779,447 | A | * | 10/1930 | Peltier | 137/533.11 |
| 2,216,573 | A | | 10/1940 | Owsley | |
| 3,023,710 | A | * | 3/1962 | Tyree, Jr. | 417/259 |
| 3,558,244 | A | | 1/1971 | Uchiyama | |
| 3,652,188 | A | | 3/1972 | Uchiyama | |
| 3,809,508 | A | | 5/1974 | Uchiyama | |
| 3,920,356 | A | | 11/1975 | Bruggeman | |
| 5,964,416 | A | | 10/1999 | Jaeger et al. | |
| 2008/0170953 | A1 | * | 7/2008 | Lund | 417/470 |
| 2009/0041588 | A1 | | 2/2009 | Hunter et al. | |
| 2010/0038070 | A1 | | 2/2010 | Blanco et al. | |

FOREIGN PATENT DOCUMENTS

| | | | |
|---|---|---|---|
| DE | 10306476 | B3 | 8/2004 |
| EP | 0580196 | A1 | 1/1994 |
| GB | 120622 | | 11/1918 |
| WO | 2009041811 | A1 | 4/2009 |

OTHER PUBLICATIONS

Cat Pumps brochure entitled "How Cat Pumps® Work?" Nov. 17, 2010, 4 pages, http://www.catpumps.com/pumps-how-they-work-piston-plunger-sf-flushed.html, Cat Pumps.
Engineers Edge brochure entitled "Plunger Pumps," http://www.engineersedge.com/pumps/positive_disp_pump_reciprocating.htm, Nov. 17, 2010, 2 pages, Engineers Edge, LLC.
Halliburton brochure entitled "HT-400(TM) Pump," Apr. 2006, 2 pages, Halliburton.
Foreign communication from a related counterpart application—International Search Report and Written Opinion, PCT/GB2012/000407, Jun. 3, 2013, 12 pages.

* cited by examiner

*Primary Examiner* — Kenneth L Thompson
(74) *Attorney, Agent, or Firm* — John W. Wustenberg; Conley Rose, P.C.

(57) ABSTRACT

A reciprocating apparatus for pumping pressurized fluid. The reciprocating apparatus comprises a plunger disposed within a cylinder, wherein the plunger is hollow and ported for enabling fluid within the cylinder to flow into the plunger. The plunger includes at least one outlet through which fluid within the plunger flows out of the plunger. In operation, the plunger retracts to displace fluid from the hollow body and into a discharge chamber, and the plunger extends towards the discharge chamber to discharge the displaced fluid. As the plunger alternately retracts and extends, fluid within the plunger continuously flows towards the discharge chamber.

23 Claims, 12 Drawing Sheets

HIGH PRESSURE STIMULATION PUMP

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present disclosure relates generally to a method and apparatus for supplying pressurized fluids. More particularly, the present disclosure relates to methods and reciprocating devices for pumping fluids into a wellbore.

BACKGROUND OF THE INVENTION

High-pressure pumps having reciprocating elements such as plungers or pistons are commonly employed in oil and gas production fields for operations such as drilling and well servicing. For instance, one or more reciprocating pumps may be employed to pump fluids into a wellbore in conjunction with activities including fracturing, acidizing, remediation, cementing, and other stimulation or servicing activities. Due to the harsh conditions associated with such activities, many considerations are generally taken into account when designing a pump for use in oil and gas operations. One design consideration may concern fatigue strength, as reciprocating pumps used in wellbore operations, for example, often encounter high cyclical pressures that can render pump components susceptible to fatigue failure.

Many reciprocating pumps are configured with a "T-type" or "X-type" fluid or liquid end in which one or more cross-bores defining flow paths intersect a pump cylinder disposed on the high-pressure side of pumps. T- and X-type fluid ends may be structurally composed using thicker walled, thus heavier, and high-strength materials to avoid fatigue issues, as intersecting T- or X-bores can create stress concentrations that increase the potential of fatigue failure. While such designs and compositions may improve structure strength, the resulting weight and bulk of the fluid end is typically unfavorable. For instance, heavier and/or larger fluid ends may still demand frequent maintenance and/or repairs over their lifespan, and therefore, impose increased costs. Accordingly, it is desirable to provide a fluid end that is strong, durable, and relatively lightweight, while also being capable of enduring harsh environments associated with the processing of fluids in high-pressure applications.

SUMMARY OF THE INVENTION

Disclosed herein is a high-pressure pump comprising a fluid end comprising at least one fluid inlet through which fluid flows into at least one intake chamber within the fluid end. The high-pressure pump further includes a plunger disposed within the at least one chamber, the plunger comprising a peripheral wall defining a hollow body, wherein the peripheral wall includes at least one inlet port through which fluid within the intake chamber flows into the hollow body. A power end is operatively connected to the plunger and is operable to reciprocate the plunger along a path within the intake chamber in alternate directions, wherein fluid continuously flows into the hollow body as the plunger reciprocates. In an embodiment, the fluid end comprises a high-pressure cylinder defining an internal discharge chamber for discharging fluid, wherein the high-pressure cylinder does not include an intersecting cross-bore such as a "T" or "X" bore.

Also disclosed herein is a system for servicing a wellbore with at least a first reciprocating pump having a plurality of plungers driven through a forward stroke and a return stroke by a common crankshaft, wherein each plunger is disposed within an intake chamber and a discharge chamber having a suction valve and a discharge valve, respectively. The system comprises a source of a wellbore servicing fluid, a first pump body assembly, and a wellbore, wherein the wellbore servicing fluid is communicated from the source into the wellbore via the first reciprocating pump. In an embodiment, the first pump body assembly comprises at least one fluid inlet through which fluid flows into each intake chamber associated with the plurality of plungers, wherein each plunger comprises a peripheral wall defining a hollow body in which the suction valve is disposed, wherein the peripheral wall includes at least one inlet port through which fluid flows into the hollow body. The first pump body assembly further comprises a discharge outlet through which fluid is discharged out of the discharge chamber and into the wellbore during forward strokes.

Further disclosed herein is a method of servicing a wellbore with a reciprocating pump having a plurality of plungers driven through a forward stroke and a return stroke by a common crankshaft, wherein each plunger is disposed within an intake chamber and a discharge chamber having a suction valve and a discharge valve, respectively. The method comprises providing a source of a wellbore servicing fluid at the wellbore, transporting the reciprocating pump to the wellbore, and fluidly coupling the reciprocating pump to the source of the wellbore servicing fluid and to the wellbore. The method further comprises communicating wellbore servicing fluid into the wellbore via the reciprocating pump, wherein wellbore servicing fluid flows in and out of each discharge chamber along a common axis, respectively, the common axis being parallel to a path in which each corresponding plunger is driven during forward strokes and return strokes. In an embodiment, the reciprocating pump comprises at least one fluid inlet through which fluid flows into each intake chamber associated with the multiple plungers. Each plunger comprises a peripheral wall defining a hollow body in which the suction valve is disposed, wherein the peripheral wall includes at least one inlet port through which fluid flows into the hollow body, and at least one outlet port through which fluid from the hollow plunger body flows into the discharge chamber during return strokes. The reciprocating pump further comprises a discharge outlet through which fluid flows out of the discharge chamber and into the wellbore during forward strokes. In one aspect, the discharger chamber is a high-pressure chamber formed within a high-pressure cylindrical body of the reciprocating pump, wherein the high-pressure cylindrical body does not include any intersecting cross-bores such as "T" or "X" bores.

BRIEF SUMMARY OF THE DRAWINGS

For a more complete understanding of this disclosure, reference is now made to the following brief description, taken in connection with the accompanying drawings and detailed description, wherein like reference numerals represent like parts.

DETAILED DESCRIPTION

It should be understood at the outset that although an illustrative implementation of one or more embodiments are provided below, the disclosed systems and/or methods may be implemented using any number of techniques, whether currently known or in existence. The disclosure should in no way be limited to the illustrative implementations, drawings, and techniques illustrated below, including the exemplary designs and implementations illustrated and described herein, but may be modified within the scope of the appended claims along with their full scope of equivalents.

Disclosed herein is a reciprocating apparatus for pumping pressurized fluid. In an embodiment, the reciprocating apparatus comprises a plunger disposed within a cylinder. The plunger is hollow and ported for enabling fluid within the cylinder to flow into the plunger. The plunger includes at least one outlet through which fluid within the plunger flows out of the plunger. In an embodiment, the reciprocating apparatus is a high-pressure pump configured to operate at a pressure greater than or equal to about 3,000 psi and/or in a well servicing operation and environment. In operation, the plunger retracts to displace fluid from the hollow body and into a discharge chamber, and the plunger extends towards the discharge chamber to discharge the displaced fluid, where the extension of the plunger also moves the fluid inside of the plunger towards the discharge chamber. As the plunger subsequently retracts, the relatively high velocity of the fluid moving inside of the plunger may generally make it difficult for the moving fluid to suddenly stop and withdraw, and therefore, the fluid velocity may help open the plunger valve and displace fluid in the discharge chamber. Hence, as the plunger alternately retracts and extends, fluid within the plunger continuously flows toward the discharge chamber.

Figure 1:
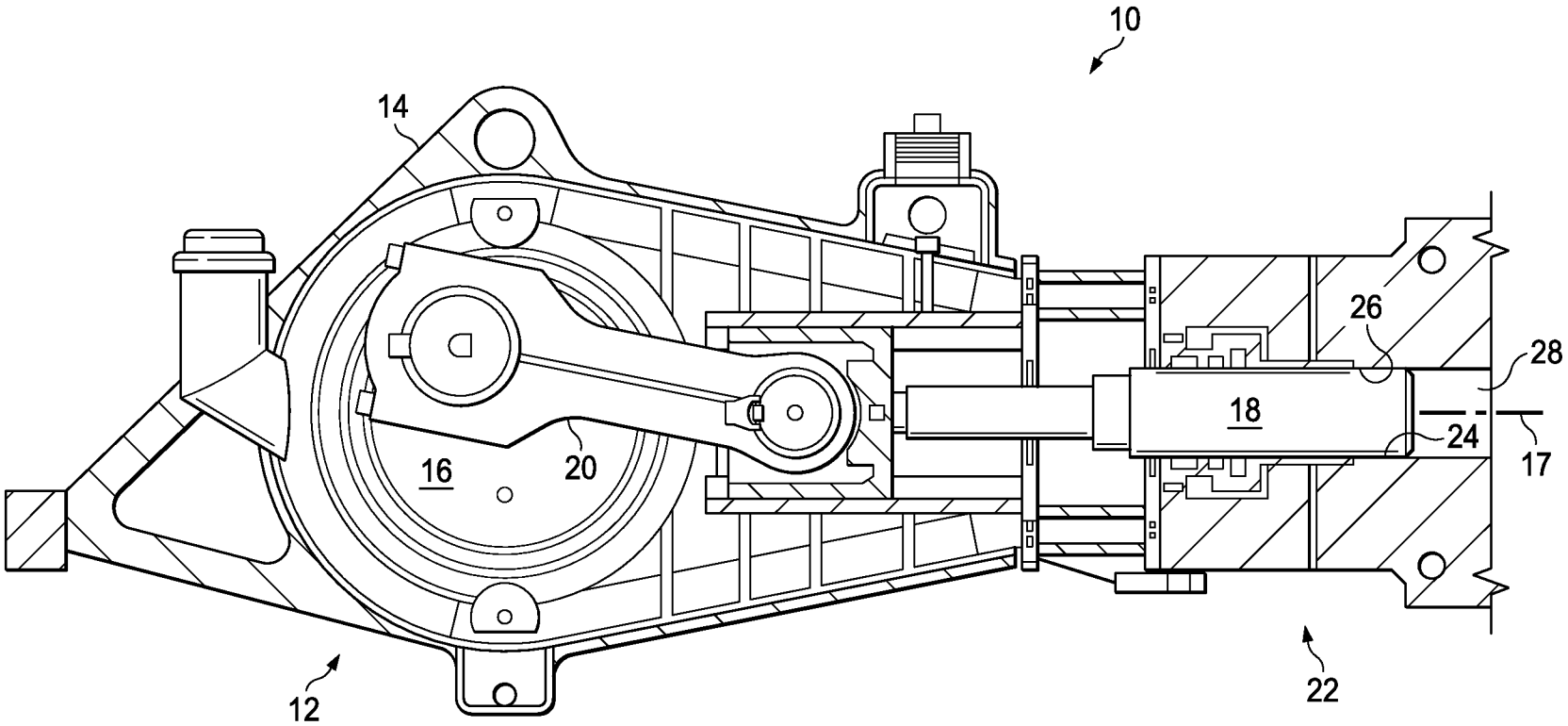
FIG. 1 is a cut-away illustration of a reciprocating apparatus according to an embodiment of the present disclosure.

FIG. 1 illustrates a cutaway of a reciprocating apparatus embodying the principles of the present disclosure. The reciprocating apparatus may comprise any suitable pump 10 operable to pump fluid. Non-limiting examples of suitable pumps include, but are not limited to, piston pumps, plunger pumps, and the like. In an embodiment, the pump 10 is a rotary- or reciprocating-type pump such as a positive displacement pump operable to displace pressurized fluid. As discussed further below, the pump 10 includes at least one input for receiving fluid from a fluid source, e.g., a suction line, suction header, storage or mix tank, discharge from a boost pump such as a centrifugal pump, etc. The pump 10 also includes at least one output for discharging fluid to a discharge source, e.g., a flowmeter, pressure monitoring and control system, distribution header, discharge line, wellhead, and the like.

The pump 10 may comprise any suitable power end 12 for enabling the pump 10 to perform pumping operations (e.g., pumping a wellbore servicing fluid downhole). Similarly, the pump 10 may include any suitable housing 14 for containing and/or supporting the power end 12 and components thereof. The housing 14 may comprise various combinations of inlets, outlets, channels, and the like for circulating and/or transferring fluid. Additionally, the housing 14 may include connections to other components and/or systems, such as, but not limited to, pipes, tanks, drive mechanisms, etc. Furthermore, the housing 14 may be configured with cover plates or entryways for permitting access to the power end 12 and/or other pump components. As such, the pump 10 may be inspected to determine whether parts need to be repaired or replaced. The power end may also be hydraulically driven, whether it is a non-intensifying or an intensifying system.

Those versed in the art will understand that the power end 12 may include various components commonly employed in pumps. Briefly, for example, the power end 12 may include a rotatable crankshaft 16 attached to at least one reciprocating element 18 (e.g., a plunger or piston) by way of a crank arm 20. Additionally, an engine, motor, or other suitable power source may be operatively connected to the crankshaft 16 (e.g., through a transmission and drive shaft) and operable to actuate rotation thereof. In operation, rotation of the crankshaft 16 induces translational movement of the crank arm/connecting rod 20, thereby causing the reciprocating element 18 to extend and retract along a flow path, which may generally be defined by a central axis 17 within a bore.

Of course, numerous other components associated with the power end 12 of the pump 10 may be similarly employed, and therefore, necessarily fall within the purview of the present disclosure. Furthermore, since the construction and operation of components associated with pumps of the sort depicted in FIG. 1 is well known and understood, discussion of the pump 10 will herein be limited to the extent necessary for enabling a proper understanding of the disclosed embodiments.

The pump 10 comprises a fluid end 22 attached to the power end 12. Various embodiments of the fluid end 22 are described in detail below in connection with other drawings. Generally, the fluid end 22 comprises at least one inlet for receiving fluid, and at least one outlet for discharging fluid. The fluid end 22 also comprises at least one valve assembly for controlling the receipt and output of fluid. The fluid end 22 may include any suitable component(s) and/or structure(s) for containing and/or supporting the reciprocating element 18 and defining a cylinder 24 having a bore 26.

In an embodiment, the fluid end 22 may comprise a cylinder 24 defining a bore 26 through which the reciprocating element 18 may extend and retract. Additionally, the bore may be in fluid communication with a chamber 28 formed within the fluid end 22. Such a chamber 28, for example, may be configured as a pressurized discharge chamber having an outlet through which fluid is discharged by the reciprocating element 18. Thus, the reciprocating element 18 may be movably disposed within the cylindrical bore 26, which may provide a fluid flow path into and/or out of the chamber 28. During operation of the pump 10, the reciprocating element 18 may be configured to reciprocate along a path (e.g., axis 17 within bore 26 and/or chamber 28) to transfer a supply of fluid to the chamber 28 and/or discharge fluid from the chamber 28.

While the foregoing discussion focused on a fluid end 22 comprising a single reciprocating element 18 disposed in a single cylinder 24, it is to be understood that the fluid end 22 may include any suitable number of cylinders or the like. As discussed further below, for example, the pump 10 may comprise a plurality of cylinders. In such a multi-cylinder pump, each cylinder may include a respective reciprocating element and crank arm, and a single common crankshaft may drive each reciprocating elements and cranks arms. Alternatively, a multi-cylinder pump may include multiple crankshafts, such that each crankshaft may drive a corresponding reciprocating element. Furthermore, the pump 10 may be implemented as any suitable type of multi-cylinder pump. In a non-limiting example, the pump 10 may comprise a Triplex pump having three reciprocating elements (e.g., plungers or pistons), or a Quintuplex pump having five reciprocating elements.

Referring now to FIGS. 2A-2D, an embodiment of a fluid end 22 comprising a pump body assembly 30 will now be described. The pump body assembly 30 generally comprises a low-pressure body 32 and a high-pressure body 34, where each body 32 and 34 may comprise one or more cylinders defining chambers through which the reciprocating element 18 may reciprocate to displace and/or discharge fluid. In an embodiment, the pump body assembly 30 may include a frame 31 (FIG. 2D) or other suitable structure for supporting components associated with the pump body assembly 30.

Figure 2A:
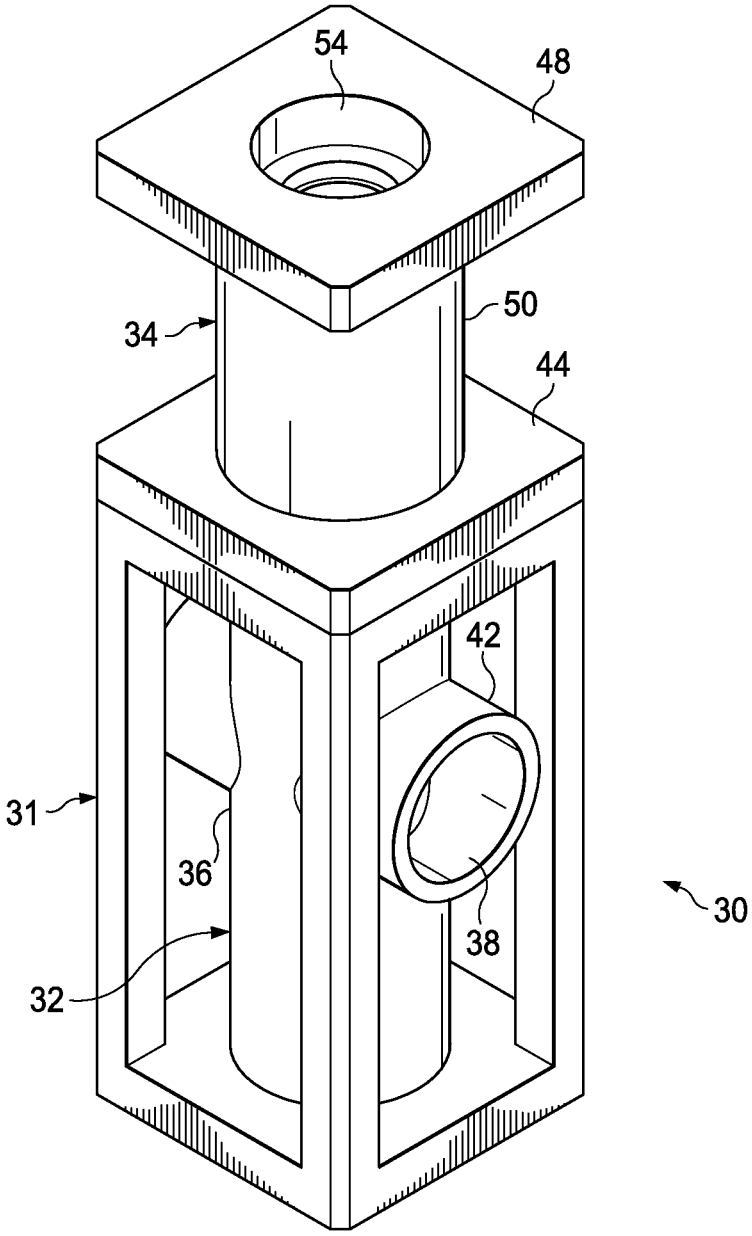
FIG. 2A is an isometric view of an embodiment of a pump body assembly associated with a fluid end.
Figure 2B:
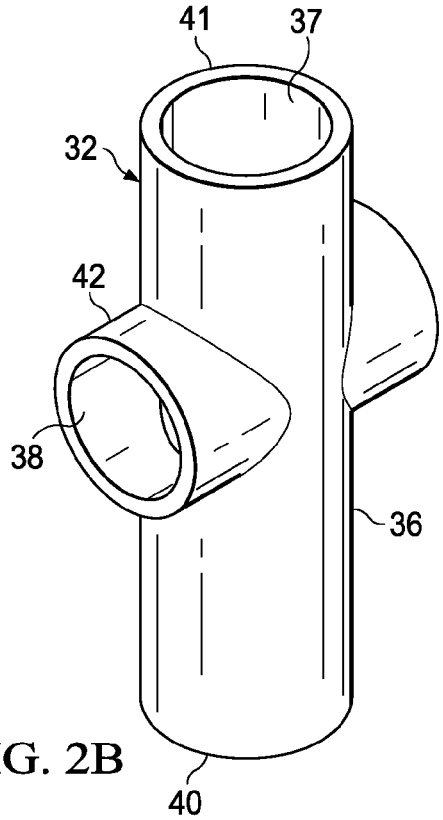
FIG. 2B is an isometric view of an embodiment of a low-pressure body depicted in FIG. 2A.

As best depicted in FIG. 2B, the low-pressure body 32 comprises a cylinder 36, which may define an internal bore configured as a low-pressure chamber 37 (or intake chamber). For instance, the cylinder 36 may comprise a low-pressure cylinder 36 having a relatively low pressure rating (e.g., about 1000 psi or less). The cylinder 36 may be generally hollow and have any suitable shape to contain and/or support at least a portion of the reciprocating element 18. For example, the cylinder 36 may be of sufficient length, diameter, and circumference to contain a full or partial stroke of the reciprocating element 18. Moreover, the cylinder 36 may be constructed using any suitable material(s), e.g., the cylinder 36 may be cast or formed from steel, metal alloys, or the like.

The low-pressure body 32 further comprises at least one fluid inlet 38 in fluid communication with a fluid source (e.g., via a fluid header). Additionally, the cylinder 36 of the low-pressure body 32 may be open-ended such that each end includes an opening. For instance, one end may define a first opening or outlet 40 through which the reciprocating element 18 may displace fluid supplied into the cylinder 36 through the fluid inlet 38. An opposite end of the cylinder 36 may define a second opening or inlet 41 through which the power end 12 may connect to the reciprocating element 18 (e.g., via crank arm 20). Those versed in the art will understand that inlets and outlets may be formed according to any suitable manner, and may include any suitable shape and/or diameter.

In an embodiment, the low-pressure body 32 may comprise a cylindrical portion 42 extending from the cylinder 36. As shown in FIGS. 2A and 2B, the cylindrical portion 42 may intersect the cylinder 36 at a perpendicular or transverse angle, thereby forming a "T-bore" or cross-bore in the low-pressure body 32. As discussed further below, such a configuration may be employed for inter-connecting multiple low-pressure cylinders in a multi-cylinder pump 10. The cylindrical portion 42 may include at least one open end configured as an inlet (e.g., fluid inlet 38) or outlet. Additionally or alternatively, one or more sections of the cylinder 36 may be ported to define one or more openings. Thus, while the fluid inlet 38 is shown in the form of an opening at an end of the cylindrical portion 42, the fluid inlet 38 may alternatively be a port formed through the sidewall of the cylinder 36.

Figure 2C:
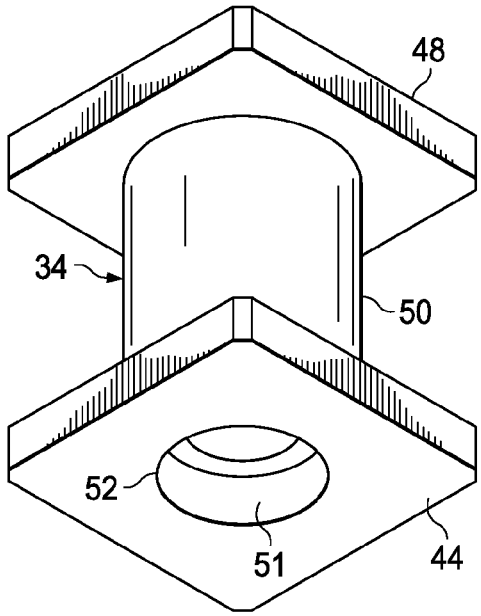
FIG. 2C is an isometric view of an embodiment of a high pressure body depicted in FIG. 2A.
Figure 2D:
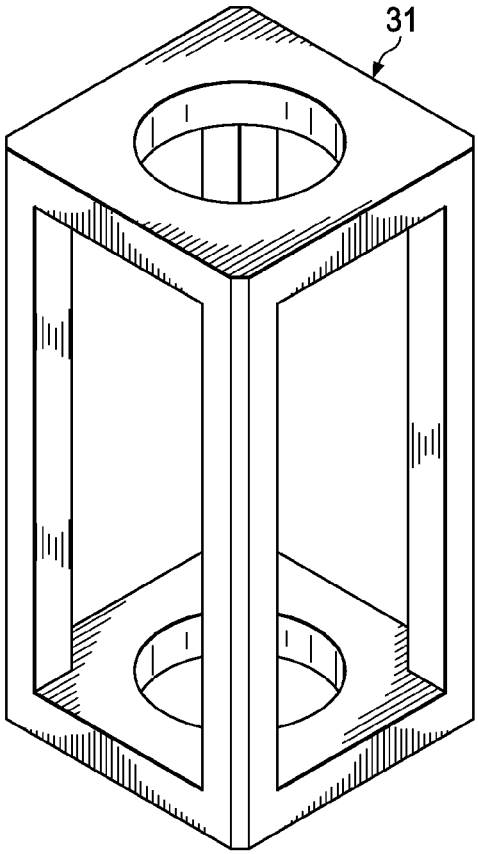
FIG. 2D is an isometric view of an embodiment of a structure for supporting components associated with the pump body assembly.

Referring now to FIGS. 2A and 2C, an embodiment of a high-pressure body 34 will now be described. The high-pressure body 34 may be attached to the low-pressure body 32 according to any suitable manner. In a non-limiting example, the high-pressure body 34 may comprise a base 44 affixed (e.g., bolted or welded) to the frame 31 or other suitable structure associated with the fluid end 22. The high-pressure body 34 may further comprise a top portion 48 or plate configured to attach (e.g., via bolting, threading, and/or welding) to a discharge source (e.g., a front-end discharge header or manifold).

In an embodiment, the high-pressure body 34 comprises a substantially cylindrical body, which may be formed by a high-pressure cylinder 50 disposed between the base 44 and the top portion 48. As shown in FIGS. 2A and 2C, the cylindrical high-pressure body 50 may be formed without an "X" bore, "T" bore, or any other type of crossing bore that would otherwise intersect the high-pressure cylinder 50. Analogous to the low-pressure cylinder 36, the high-pressure cylinder 50 is generally hollow and may be of any suitable size and/or shape. The high-pressure cylinder 50 includes an internal bore configured as a high-pressure chamber 51 (or discharge chamber) for discharging fluid. In some implementations, the high-pressure chamber 51 may be substantially coaxial (e.g., along central axis 17) with the low-pressure chamber 37. The high-pressure cylinder 50 may also include a first open end defining an inlet 52 through which fluid from the cylinder 36 (e.g., via outlet 40) may flow into, and a second open end defining an outlet 54 through which fluid may be discharged. The inlet 52 and the outlet 54 may each be of any suitable size and/or shape (e.g., circular or cylindrical). In one aspect, the inlet 52 may be substantially similar to the outlet 40 of the low-pressure cylinder 36. For instance, the outlet 40 and the inlet 52 may each include an inner diameter slightly greater than the outer diameter of the reciprocating element 18, such that the reciprocating element 18 may sufficiently reciprocate within each cylinder 36 and 50, respectively. In an embodiment, the high-pressure body has a pressure rating ranging from about 100 psi to about 3000 psi, or from about 2000 psi to about 10,000 psi, or from about 5000 psi to about 30,000 psi or greater. Additionally or alternatively, the pressure differential between the low-pressure cylinder 36 and the high-pressure cylinder is about 3,000 psi, or 10,000 psi, or 30,000 psi ore greater.

The high-pressure body 34 may be cast or formed from any suitable materials, e.g., steel, metal alloys, or the like. Those versed in the art will recognize that the type and condition of material(s) suitable for the high-pressure body 34 may be selected based on various factors. In a wellbore servicing operation, for example, the selection of a material may depend on flow rates, pressure rates, wellbore service fluid types (e.g., particulate type and/or concentration, or cryogenic/foams), etc. Moreover, the high-pressure body 34 may include protective coatings for preventing and/or resisting abrasion, erosion, and/or corrosion.

In an embodiment, the cylindrical shape (i.e., cylinder 50) of the high-pressure body 34 may be pre-stressed in an initial compression. Moreover, the high-pressure cylinder 50 may comprise one or more sleeves (e.g., heat-shrinkable sleeves). Additionally or alternatively, the high-pressure cylinder 50 may comprise one or more composite overwraps and/or concentric sleeves ("over-sleeves"), such that an outer wrap/sleeve pre-loads an inner wrap/sleeve. The overwraps and/or over-sleeves may be non-metallic (e.g., fiber windings) and/or constructed from relatively lightweight materials. Overwraps and/or over-sleeves may be added to increase fatigue strength and overall reinforcement of the components.

The cylinders and cylindrical-shaped components associated with the pump body assembly 30 may be held in place within the pump 10 using any appropriate technique. For example, components may be assembled and connected, e.g., bolted, welded, etc. Additionally or alternatively, cylinders may be press-fit into openings machined or cast into the fluid end 22 or other suitable portion of the pump 10. Such openings may be configured to accept and rigidly hold cylinders in place so as to facilitate interaction of the reciprocating element 18 and other components associated with the pump 10. Furthermore, while the pump body assembly 30 has been described as comprising a low-pressure body 32 and a high-pressure body 34 having separate cylindrical structures, it is to be understood that the pump body assembly 30 may comprise additional bodies having one or more cylinders, or a single body having any number of cylinders.

Figure 3A:
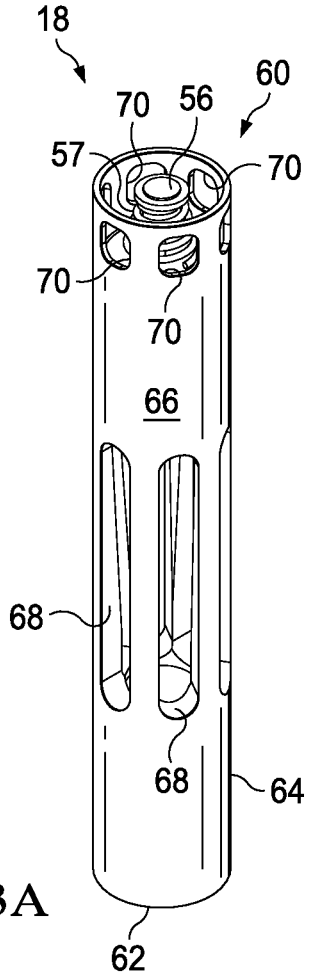
FIGS. 3A and 3B are isometric views of an embodiment of a reciprocating element.
Figure 3B:
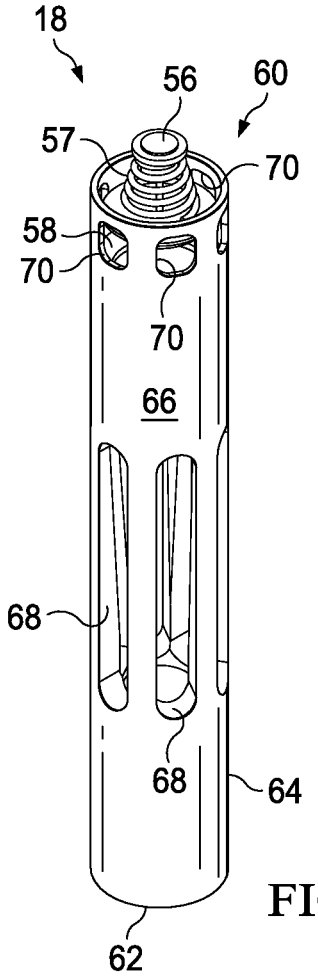

Referring now to FIGS. 3A and 3B, the reciprocating element 18 will now be described. In an embodiment, the reciprocating element 18 comprises a plunger. As skilled artisans will understand, the plunger 18 may include any suitable size and/or shape for extending and retracting along a flow path within the pump body assembly 30. For instance, the plunger 18 may comprise a generally cylindrical shape, and may be sized such that the plunger 18 can sufficiently slide against or otherwise interact with the inner walls of the low-pressure cylinder 36 and/or the high-pressure cylinder 50. In an embodiment, one or more additional components or mechanical linkages may be used to couple the plunger 18 to the crank arm 20.

In an embodiment, the reciprocating element contains a suction valve 56 operable to slidably engage a seat 58 (FIG. 3B). Skilled artisans will understand that the suction valve 56 may be of any suitable type or configuration (e.g., gravity- or spring-biased, flow activated, etc.). In one aspect, the suction valve 56 is disposed within the plunger 18 at or proximate to a front end 60 thereof. At an opposite or tail end 62 of the plunger 18, the plunger 18 may include a base 64 attached to the power end 12 of the pump 10 (e.g., via crank arm 20).

In an embodiment, the plunger 18 comprises a peripheral wall 66 defining a hollow body. Additionally, a portion of the peripheral wall 66 may be generally permeable or may include an input through which fluid may enter the hollow body. In one aspect, the peripheral wall 66 includes a ported portion comprising a plurality of inlets or ports 68 for enabling fluid to flow into and/or through the hollow body of the plunger 18. The ports 68 may be machined or otherwise formed into the peripheral wall 66 according to various known techniques. It is to be understood that the ported portion of the plunger 18 may comprise any suitable number of ports 68, including a single port.

As shown in FIGS. 3A and 3B, the ports 68 may comprise a series of axial slots or elongated tubular grooves formed around a central body portion that extend parallel to the plunger's axis of reciprocation (e.g., central axis 17). Nonetheless, it is to be understood that the ports 68 are not so limited, as skilled artisans will readily appreciate that the ports 68 may be shaped, sized, and/or positioned according to any suitable manner. Similarly, one or more ports 68 may be shaped, sized, and/or positioned differently, as the ports 68 do not necessarily need to be identical with each other. Furthermore, while the plunger 18 may define a substantially hollow interior and include a ported body 66, the base 64 of the plunger 18 may be substantially solid and/or impermeable.

In an embodiment, the plunger 18 comprises a plurality of outlets or ports 70 through which fluid may flow out of the plunger 18. As shown in FIGS. 3A and 3B, the outlet ports 70 may be formed at or proximate to the front end 60 and circumferentially arranged around an upper or head portion of the hollow plunger body 66, e.g., in a wall area or circumference extending beyond the seat 58. Additionally, the outlet ports 70 may be generally circular such that each port 70 defines a central axis that is substantially perpendicular to the axis or direction of reciprocation (e.g., central axis 17). Analogous to the inlet ports 68, however, it is to be understood that each port 70 may be shaped, sized, and/or positioned according to any suitable manner. Furthermore, the plunger 18 may comprise more or less (e.g., one) outlet ports 70 than shown in the drawings, as the outlet ports do not necessarily need to be identical. Additionally or alternatively, the hollow plunger body 66 may have ports 68 on or about its bottomside (e.g., tail end 62, lower portion of the base 64, etc.). As discussed further below, in some implementations the hollow plunger body 66 may have a substantially smaller cylindrical solid shaft 65 connected to the crank arm 20 of the power end 12 (e.g., the base 64, or a portion thereof, may be of a smaller diameter forming a base extension 65).

As the plunger 18 reciprocates during operation, the suction valve 56 is generally configured to disengage or engage the seat 58 within the plunger 18 to either allow or prevent fluid within the plunger 18 to flow through the ports 70. For instance, the seat 58 associated with the suction valve 56 may be disposed upstream of the ports 70 (e.g., between inlet ports 68 and outlet ports 70). In this manner, fluid within the hollow body 66 will be blocked from flowing past the seat 58 when the suction valve 56 is closed or otherwise in sealing engagement with the seat 58 (FIG. 3A). Additionally, the suction valve 56 may slide away from the seat 58 in a direction towards the front end 60, such that the bottom or seating end of the suction valve 56 is generally at least partially downstream of the ports 70 when the suction valve 56 is open (FIG. 3B). As the suction valve 56 opens, fluid within the plunger 18 may radially flow out of the ports 70.

Additionally or alternatively, the suction valve 56 may be configured to slide beyond the front end 60, such that the suction valve 56 is outside of the plunger 18 when the suction valve 56 is open, which may provide an open area for fluid flow in addition or in lieu of ports 70. As shown in FIGS. 3A and 3B, for example, the front end 60 of the plunger 18 may define an opening through which the suction valve 56 may slide. As such, the seat 58 may be disposed within the plunger 18 such that the suction valve 56 may slide through the opening and out of the plunger 18 as the suction valve 56 moves away from the seat 58 to open. Accordingly, fluid within the plunger 18 may flow through the opening at the proximate end 60 and/or through the ports 70 (if included).

While the reciprocating element 18 has been described above with respect to a plunger 18, it is to be understood that the reciprocating element 18 may comprise any suitable component for displacing fluid. In a non-limiting example, the reciprocating element 18 may be a piston. As those versed in the art will readily appreciate, a piston-type pump generally employs sealing elements (e.g., rings, packing, etc.) attached to the piston and movable therewith. In contrast, a plunger-type pump generally employs fixed or static seals through which the plunger moves during each stroke (e.g., suction stroke or discharge stroke).

Figure 4A:
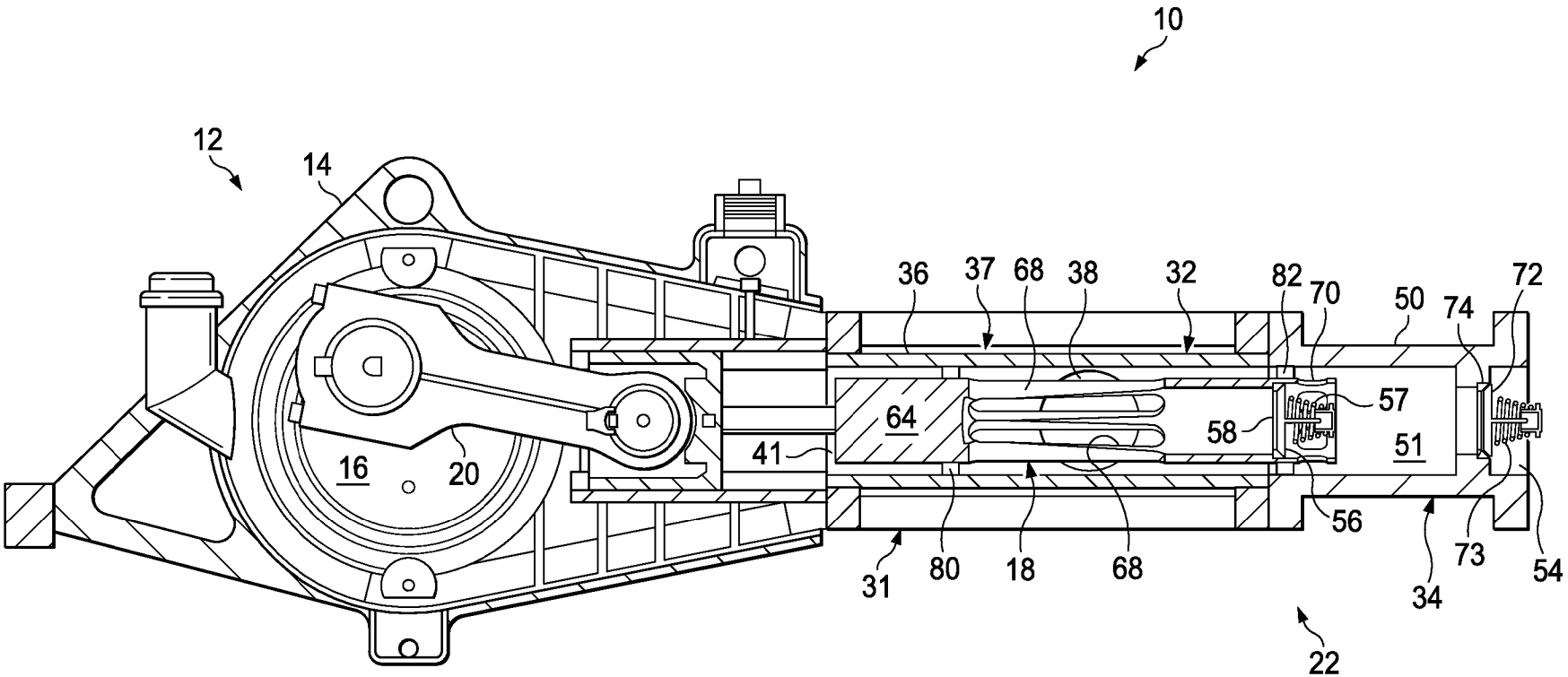
FIG. 4A is a cut-away illustration of an embodiment of a reciprocating apparatus comprising the pump body assembly depicted in FIG. 2A.

FIG. 4A is a cross-sectional view of an embodiment of a reciprocating pump 10 configured to perform high pressure applications. In a non-limiting example, the pump 10 may take the form of a positive displacement pump, which may be configured to operate at pressures of about 10,000 psi to about 30,000 psi or higher. The pump 10 may comprise any suitable power end, such as the power end 12 described above and shown in FIG. 1. The power end 12 is attached to the plunger 18 through the open end 41 (e.g., via crank arm 20 and/or other suitable linkages) of the cylinder 36 of the low-pressure body 32. In an embodiment, the plunger 18 may be disposed within the low-pressure cylinder 36 such that the inlet ports 68 are substantially contained within the low-pressure chamber 37. Similarly, the plunger 18 may be disposed within the high-pressure cylindrical body 34 such that the outlet ports 70 are substantially contained within the high-pressure chamber 51. Those familiar in the art will understand that the plunger 18 may be structurally configured according to any suitable manner. As shown in FIG. 4A, for example, the hollow body of the plunger 18 may be generally conical to provide increased column strength.

In an embodiment, one or more seals 80 (e.g., "o-ring" seals, packing seals, or the like) may be fixedly arranged around the plunger 18 to provide sealing between the outer walls of the plunger 18 and the inner walls of the low pressure cylinder 36. Similarly, one or more seals 82 may be fixedly arranged around the plunger 18 to provide sealing between the outer walls of the plunger 18 and the inner walls of the high-pressure cylindrical body 34. Skilled artisans will recognize that the seals 80 and 82 may comprise any suitable type of seals, and the selection of seals may depend on various factors e.g., fluid, temperature, pressure, etc.

Figure 4B:
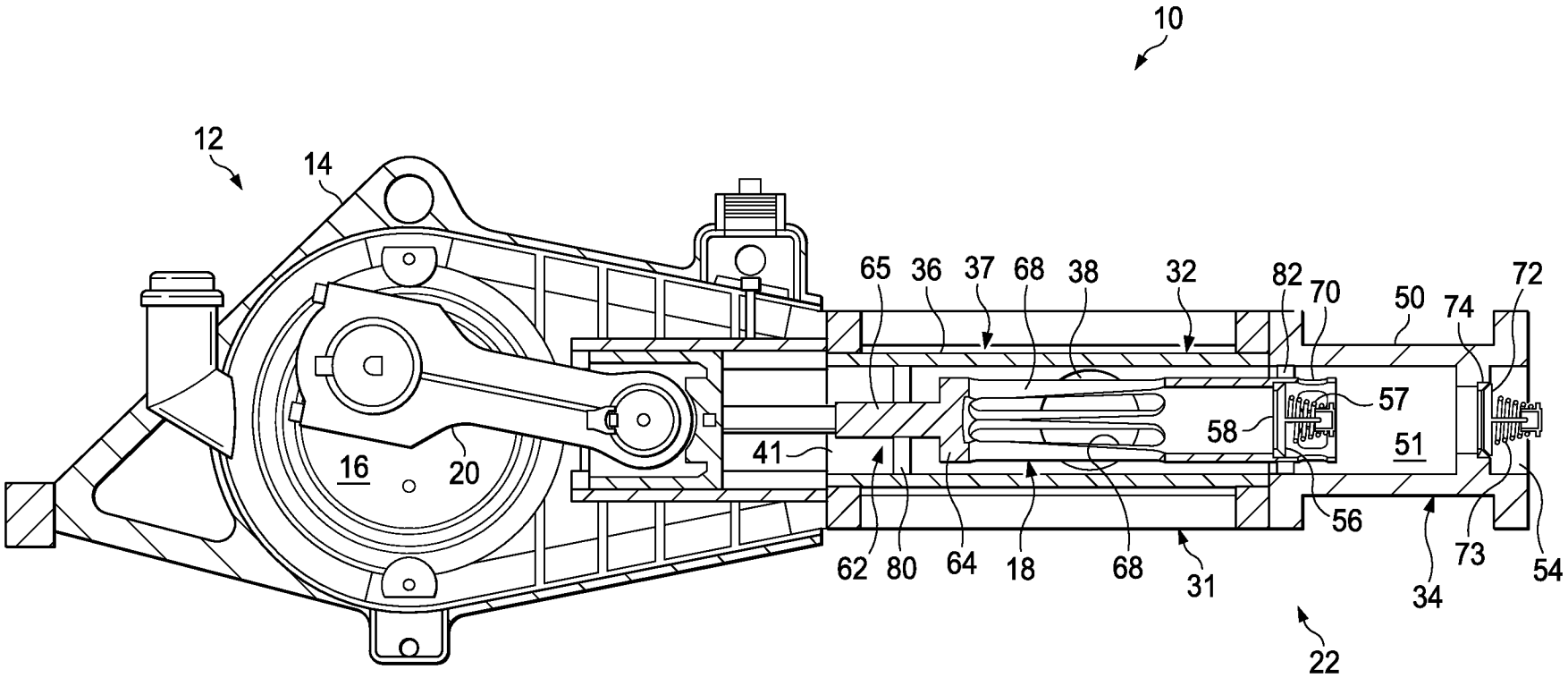
FIG. 4B is a cut-away of illustration of an alternative embodiment of the reciprocating apparatus depicted in FIG. 4A.

In some implementations, the inner and/or outer diameter of the plunger 18 may be modified to adjust fluid flow rates. As shown in FIG. 4B, for example, a section 65 extending from the tail end 62 of the plunger 18 may be formed with a smaller outer diameter than the outer diameter of an upper portion of the base 64, and one or more seals 80 may be provided slightly beneath the base 64 on or about the base extension 65. As discussed further below, such a configuration may be provided to increase fluid intake during pump operation. In some embodiments, for example, this configuration may allow for a continuous flow of fluid into and/or through the hollow body 66 via inlet ports 68.

The pump 10 may comprise any suitable fluid source for supplying fluid to the low-pressure chamber 37 via the inlet 38. In an embodiment, the pump 10 may also comprise a pressure source such as a boost pump fluidly connected to the low-pressure chamber 37 (e.g., via inlet 38) and operable to increase the pressure of fluid introduced therein. A boost pump may comprise any suitable type including, but not limited to, a centrifugal pump, a gear pump, a screw pump, a roller pump, a scroll pump, a piston pump, or any combination thereof. For instance, the pump 10 may comprise a boost pump known to operate efficiently in high-volume operations and/or may allow the pumping rate therefrom to be adjusted. Skilled artisans will readily appreciate that the amount of added pressure may depend and/or vary based on factors such as operating conditions, application requirements, etc. In one aspect, the boost pump may have an outlet pressure greater than or equal to about 70 psi, about 80 psi, or about 110 psi. Additionally or alternatively, the boost pump may have a flow rate of greater than or equal to about 80 BPM, about 70 BPM, and/or about 50 BPM.

As shown in FIG. 4A, the inlet 38 may be arranged on a side of the plunger 18 such that fluid flows into a generally central portion of the plunger 18 via the inlet ports 68. It is to be understood, however, that the inlet 38 may be arranged within any suitable portion of the low-pressure body 32 and configured to supply fluid to the low-pressure chamber 37 in any direction and/or angle. Moreover, the fluid end 22 may comprise any suitable conduit (e.g., pipe, tubing, or the like) through which a fluid source may supply fluid to the low-pressure chamber 37.

The flow of fluid within the low- and high-pressure chambers 37 and 50 is detailed in a discussion below describing operation of the pump 10. In general, fluid flowing into and within the plunger 18 will flow in a forward or positive direction towards the suction valve 56. As the suction valve 56 opens, fluid will flow through the outlet ports 70 and into the high-pressure chamber 51. Fluid within the high-pressure chamber 51 will be pumped out of the front end of the pump 10 through the discharge outlet 54, which may be connected to a discharge source such as a discharge manifold pipe.

As shown in FIG. 4A, the high-pressure body 34 may comprise a discharge valve 72 for controlling the output of fluid through the discharge outlet 54. Analogous to the suction valve 56, the discharge valve 72 may alternately engage a corresponding seat 74 to permit or prevent fluid flow. Those versed in the art will understand that the discharge valve 72 may be disposed within the high-pressure body 34 at any suitable location therein. For instance, the discharge valve 72 may be disposed proximate to the top portion 48 such that the discharge valve 72 moves through an opening formed at the discharge outlet 54. In addition, the discharge valve 72 may be co-axially aligned with the suction valve 56 (e.g., along central axis 17), and each valve 56 and 72 may be coaxially aligned with the plunger 18 (e.g., along central axis 17). Further, although the suction valve 56 and the discharge valve 72 are shown as having corresponding springs 57 and 73, respectively, it is to be understood that the any suitable mechanism may be employed for opening and closing valves. Similarly, in embodiments in which spring-biased valves are used, such valves may be arranged differently than shown in FIG. 4A. For instance, the suction spring 57 may be disposed on the opposite side of the suction valve 56 in order to reduce the volume of unswept fluid. Additionally, any suitable structure (e.g., valve assembly comprising sealing rings, stems, etc.) and/or components may be employed for retaining the suction valve 56 within the plunger 18 and the discharge valve 72 within the high-pressure body 34.

In operation, the plunger 18 extends and retracts along a flow path to alternate between providing forward strokes and return strokes, respectively. During a forward stroke, the plunger 18 extends away from the power end 12 and towards the discharge valve 72. Before the forward stoke begins, the plunger 18 is in a fully retracted position, in which case the suction valve 56 is open to allow fluid within the plunger 18 to flow through the outlet ports 70 and into the high-pressure chamber 51. In contrast, the discharge valve 72 is closed (e.g., under the influence of spring 73 and the high pressure in the discharge pipe or manifold of the high-pressure body 34), which causes pressure in the high-pressure chamber 51 to accumulate upon stroking of the plunger 18. When the plunger 18 begins the forward stroke, the pressure builds inside the high-pressure chamber 51 and acts as an opening force that lifts the discharge valve 72 open, while a closing force (e.g., via spring 57) urges the suction valve 56 against its seat 58. As the plunger 18 extends forward, fluid within the high-pressure chamber 51 is discharged through the outlet 54, while fluid flowing inside the plunger 18 moves forwardly towards the discharge valve 72 at a velocity equal to or substantially equal to the velocity of plunger 18. In other embodiments where the extension section 65 near the power end 12 is smaller, fluid from the inlet port 38 is simultaneously suctioned into the low-pressure chamber 37 such that fluid continuously flows into the hollow body 66 as the plunger 18 reciprocates in alternate directions.

During a return stroke, the plunger 18 reciprocates or retracts away from the discharge valve 72 and towards the power end 12 of the pump 10. Before the return stroke begins, the plunger 18 is in a fully extended position, in which case the discharge valve 72 is open and the suction valve 56 is closed. When the plunger 18 begins and retracts towards the power end 12, a spring 73 urges the discharge valve 72 against its seat 74, while a force such as that applied by pressurized fluid within the body 66, in addition to the kinetic energy of the fluid within the body 66, urge the suction valve 56 open. Moreover, since the suction valve 56 is disposed within the plunger 18, the mass of the suction valve 56 aids in lifting the suction valve 56 from its seat 58 when the plunger 18 retracts towards the power end 12. As the plunger 18 moves away from the discharge valve 72 during a return stroke, fluid within the plunger 18 flows through the outlet ports 70 and into the high-pressure chamber 51.

In an embodiment, a fluid source may be configured to provide a steady supply of fluid to the plunger 18 (e.g., via inlet 38). In this case, after a return stroke ends, fluid will continue to flow into the plunger 18 during a forward stroke (i.e., despite the closure of the suction valve 56). As the plunger 18 moves towards the discharge valve 72 during a forward stroke, fluid within the plunger 18 similarly flows forward in a direction towards the discharge valve 72. As the plunger 18 slows down at the end of the forward stroke, fluid flowing within the plunger 18 applies pressure against the bottom surface of the suction valve 56. However, since the suction valve 56 is disposed within the plunger 18 such that its spring 57 urges the suction valve 56 against its seat 58 as the plunger 18 extends forward, the inertia of the spring-biased suction valve 56 helps keep the suction valve 56 seated as the plunger 18 extends forward. As such, a force of fluid acts against an inertial force of the suction valve 56 during the forward stroke.

When the plunger 18 reaches the end of the forward stroke and stops (fully extended position), the fluid velocity within the plunger 18 creates a water-hammer effect once the discharge valve 72 closes. For instance, fluid flowing forward within the plunger 18 acts to apply an opening force against the suction valve 56, which is also urged open by the mass of the suction valve 56 once the plunger 18 begins to retract. Therefore, the suction valve 56 may open more quickly, which may reduce problems such as cavitation (i.e., the formation of vapor bubbles).

Figure 7A:
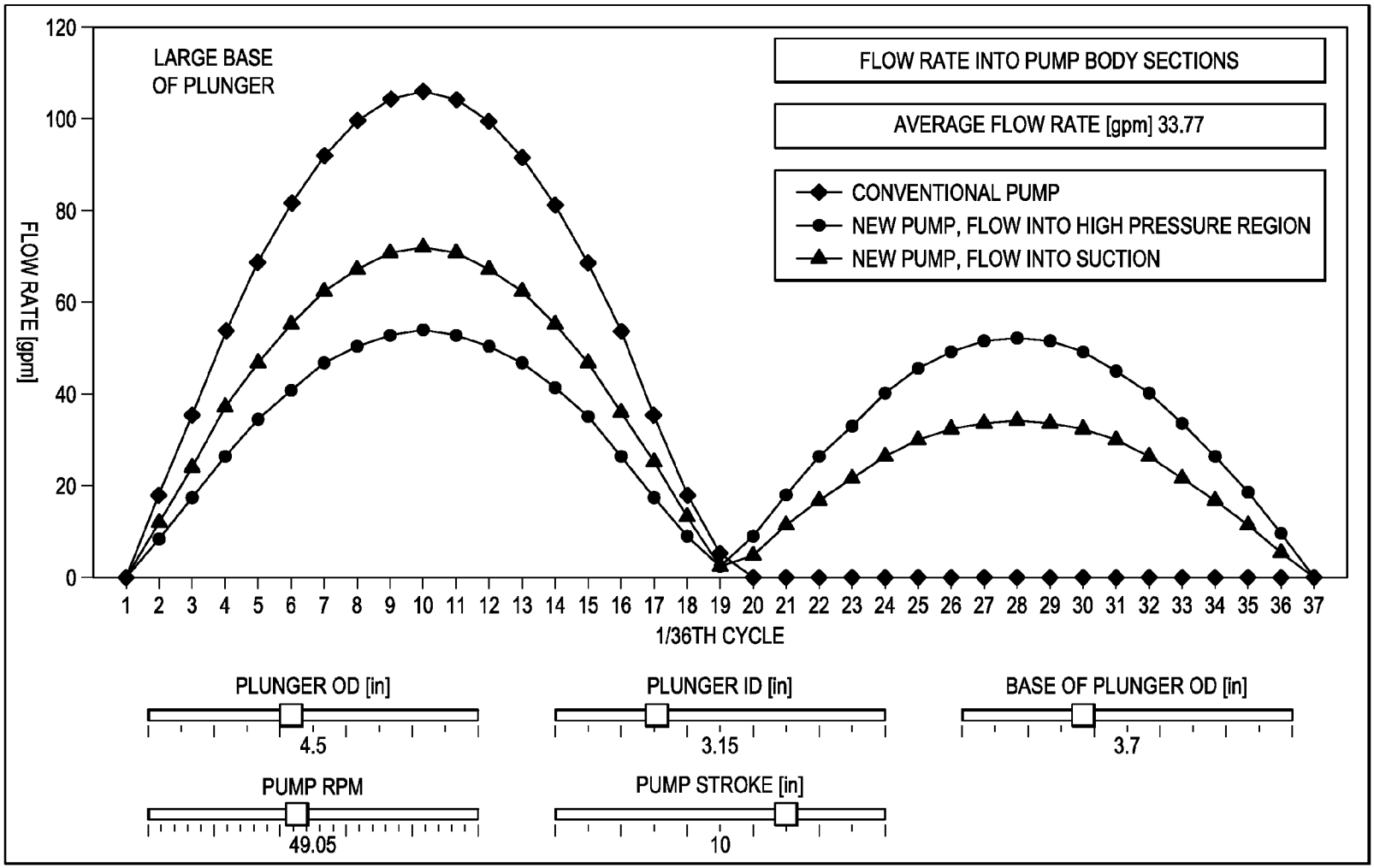
FIGS. 7A-7C are wave diagrams corresponding to fluid flow rates during each pump cycle of a conventional pump and a pump according to embodiments of the present disclosure.
Figure 7B:
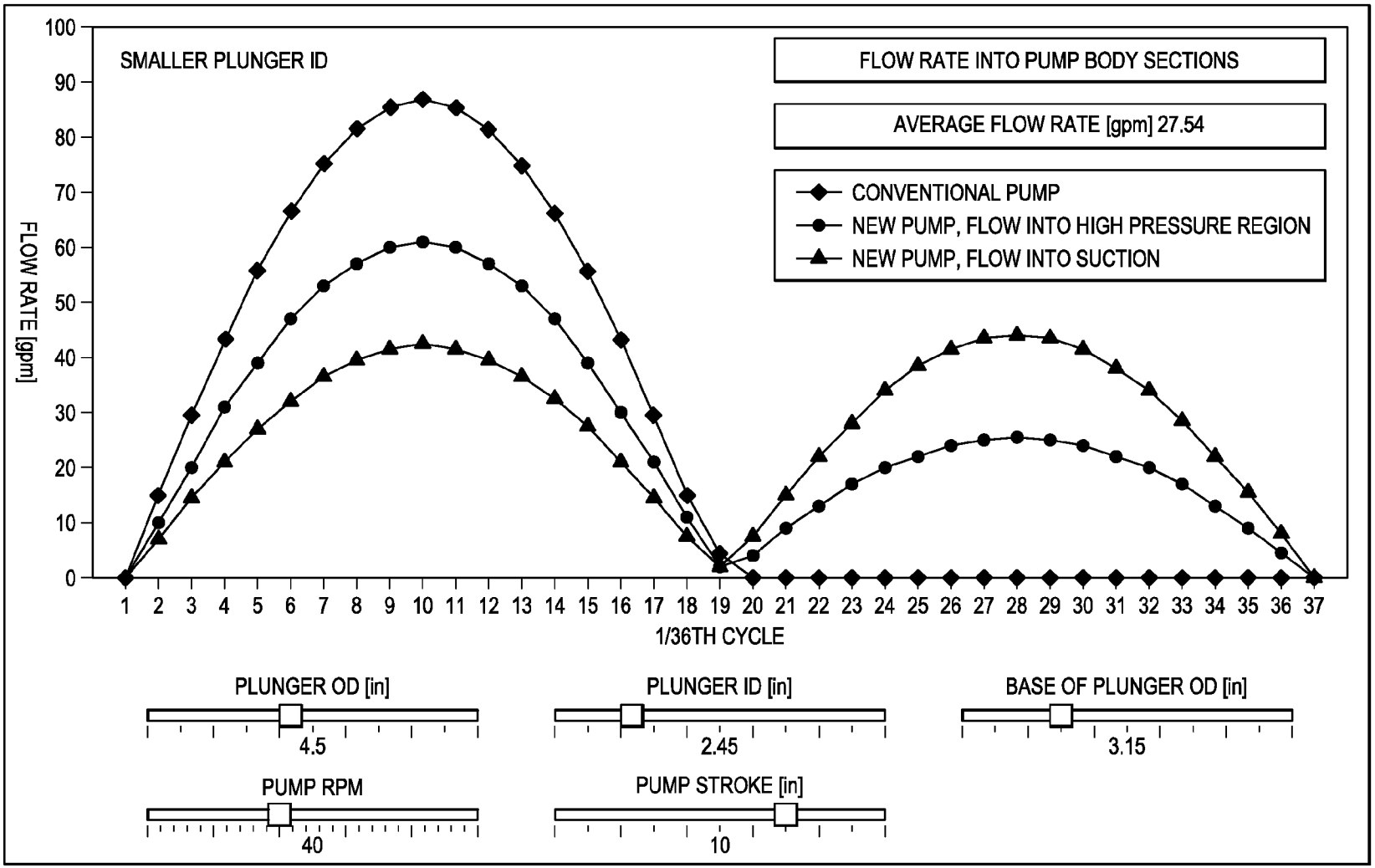
Figure 7C:
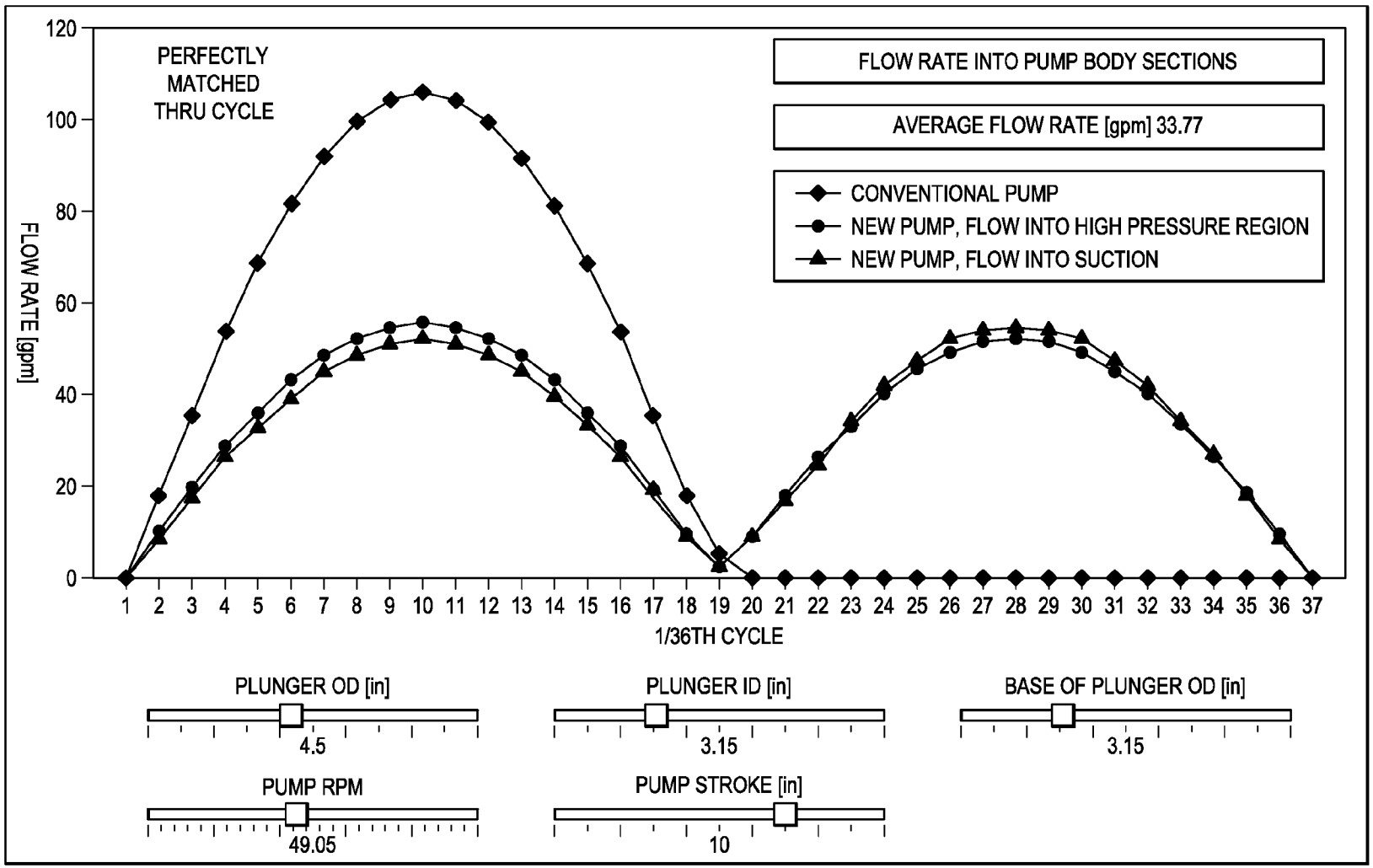

Referring to FIGS. 7A-7C, waveforms are shown depicting a comparison between fluid flow rates associated with an example of an ordinary pump ("Conventional Pump") and a pump 10 according to the teachings of the present disclosure. In FIGS. 7A-7C, the fluid flow rates during suction stroke of the Conventional Pump is represented by a single curve that peaks at the midpoint of a pump suction cycle (half cycle), whereas the fluid flow rates of the New Pump is represented by a continuous curve having a pair of peaks defining a valley therebetween during the complete cycle of the pump. As previously mentioned, the plunger 18 may be constructed with different inner and/or outer diameters, where the construction may be based on various factors such as structure strength, operating pressures, etc. The waveforms in FIGS. 7A-7C illustrate several examples as to how modifying the inner and outer diameters of the plunger 18 may affect the rate of fluid flow. To optimize performance, the diameters may be adjusted such that the cyclic fluid flows into the low-pressure chamber 31 and into the discharge region 51 of the high-pressure body 34 are constant. However, this may not be possible to achieve without complicating various arrangements in some cases, and therefore, the diameters selected in such cases may result in a waveform with less fluctuations.

While the waveforms in FIGS. 7A-7C are based on examples in which the outer diameter for the plunger body 66 is larger than both the inner diameter and the outer diameter of the base 64, it is to be understood that in other implementations the outer diameter may be lower than the inner and/or base diameters. In FIG. 7A, the New Pump waveforms corresponds to a pump 10 employing a plunger 18 similar to that depicted in FIG. 4B, wherein the plunger 18 is formed with an inner diameter (ID) that is optimized—e.g., such that the flow of fluid into the discharge region 51 has the least fluctuations (resulting in a waveform having two equal low peaks, as shown). The outer diameter (OD) of the base plunger 65 was made larger than optimal (e.g., such that the flow of fluid does not provide two equal low peaks of suction flow). The configuration of FIG. 7A might be implemented as an approach to increase the structural strength of the plunger 18. In FIG. 7B, the New Pump waveforms correspond to a similar pump 10 except that the OD of the lower base 65 is optimized (shown in FIG. 7B as equal low peaks of suction flow) for a plunger 18 formed with a smaller ID than optimal. This configuration may similarly be selected for structural strength issues. In another embodiment, the ID of the plunger 18 may be designed to be larger than optimal in order to reduce friction of fluid flowing through the plunger 18, while improving the water-hammer effect on the intake valve 56 such that it may open rapidly during the initial stage of the suction stroke.

Based on FIGS. 7A and 7B, it can be seen that setting the ID of the plunger 18 to a value such as the OD of the plunger 18 divided by about 1.41 (or square root of 2), as in FIG. 7A, for example, may result in a more balanced fluid flow into the high-pressure region of the pump 10. On the other hand, setting the ID to a smaller value while setting the OD of the base extension 65 to a value such as the OD of plunger 18 divided by about 1.41, as in FIG. 7B, for example, may result in a more balanced fluid flow into the suction or low-pressure side of the pump 10. In FIG. 7C, it can be seen that when the ID of the plunger 18 is equivalent to the OD of the base 64 (e.g., as depicted in FIG. 4A) and also equivalent to a value such as the OD of the plunger 18 divided by about 1.41, the rate of fluid flow into the low-pressure region and into the high pressure region is about the same during each cycle of the pump 10. In other words, the fluid flow rate is the same irrespective of whether the plunger 18 is extending during a forward stroke or retracting during a reverse stroke.

In each of the examples depicted in FIGS. 7A-7C, it can be seen that during operation of a New Pump according to the present disclosure, the rate of fluid flowing through the low-pressure chamber 37 continues throughout the full cycle of the pump. As such, fluid continuously flows into a region of the low-pressure chamber 37 during both the retraction/suction and compression/extension strokes. This continuous flow may help reduce the loss of boost pressure that is often experienced in conventional plunger pump designs, and therefore, substantially less boost pressures may be required for pumps according to the present disclosure.

Figure 5A:
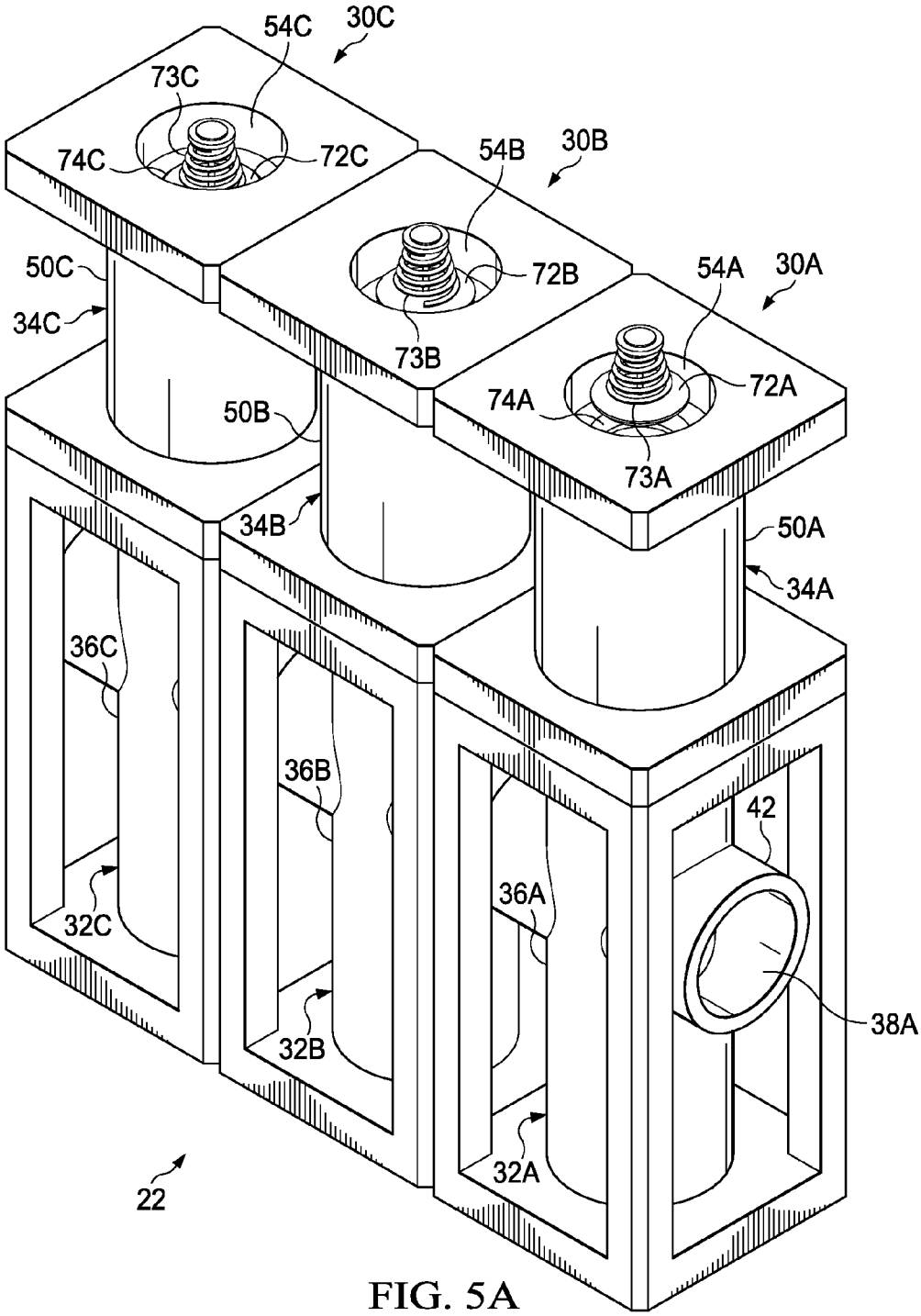
FIG. 5A is an isometric view of an embodiment of a fluid end comprising a plurality of pump body assemblies.

FIG. 5A illustrates an isometric view of an embodiment of a fluid end 22 for a multi-cylinder pump. As previously discussed, the pump 10 may be implemented as a multi-cylinder pump comprising multiple cylinders and corresponding components. In the embodiment depicted in FIG. 5A, for example, the pump 10 is a Triplex pump in which the fluid end 22 comprises three pump body assemblies 30A, 30B, and 30C. In a non-limiting example, the pump 10 may be an HT-400™ Triplex Pump, produced by Halliburton Energy Service, Inc.

Each pump body assembly 30A, 30B, and 30C is generally equivalent to the pump body assembly 30 depicted in FIGS. 2A-2D. In one aspect, the pump body assemblies 30A, 30B, and 30C may be fluidly interconnected by way of a hollow inter-cylinder or cylindrical portion 42 defining a fluid passageway therein. The cylindrical portion 42 may comprise a single cylinder or multiple cylinders (e.g., one or more cylinders associated with low-pressure body 30A, 30B, and/or 30C). At least one end of the cylindrical portion 42 includes an inlet 38A in fluid communication with a fluid source.

While the low-pressure bodies 32A, 32B, and 32C are shown as being interconnected via cylindrical portion 42, skilled artisans will appreciate that the low-pressure bodies 32A, 32B, 32C may be interconnected according to any suitable manner. Similarly, the low-pressure bodies 32A, 32B, 32C may be interconnected at different angles (e.g., transverse angles) by increasing or decreasing the angles at which the cylinder portion 42 intersects each body 32A, 32B, 32C. In one implementation, the fluid end 22 may be configured without a cross-bore or "T-bore" type of configuration. Moreover, the pump body assemblies 30A, 30B, and 30C may not be fluidly and/or physically interconnected.

In an embodiment, the fluid end 22 may comprise an external manifold (e.g., a suction header) for feeding fluid to the low-pressure chambers 37A, 37B, and 37C via any suitable inlet(s). Additionally or alternatively, the fluid end 22 may comprise separate conduits such as hoses fluidly connected to separate inlets for inputting fluid to each low-pressure body 32A, 32B, and 32C. In an embodiment, a dedicated inlet is provided on each of the low-pressure chambers 37A, 37B, and 37C with no cross flow of fluid between the chambers. Of course, numerous other variations may be similarly employed, and therefore, necessarily fall within the scope of the present disclosure.

Operation of the multi-cylinder pump 10 will now be described with reference to FIG. 5B, which is a cross-sectional view of the fluid end 22 depicted in FIG. 5A. Those versed in the art will understand that the plungers 18A, 18B, and 18C may be operatively connected to the power end 12 of the pump 10 according to any suitable manner. For instance, separate connectors (e.g., cranks arms, connecting rods, etc.) associated with the power end 12 may be coupled to each plunger body or base 64A, 64B, and 64C. The pump 10 may employ a common crankshaft (e.g., crankshaft 16) or separate crankshafts to drive the plungers 18A, 18B, and 18C.

As previously discussed, the plungers 18A, 18B, and 18C may receive a supply of fluid from any suitable fluid source, which may be configured to provide a constant fluid supply. Additionally or alternatively, the pressure of supplied fluid may be increased by adding pressure (e.g., boost pressure). In a non-limiting example, the low-pressure chambers 37A, 37B, and 37C may receive a supply of pressurized fluid comprising a pressure ranging from about 30 psi to about 300 psi.

In operation, a fluid source provides a supply of fluid through the inlet 38A, as indicated by arrow 100. Fluid entering the inlet 38A flows along a common passageway defined by the hollow interior of the cylindrical portion 42. As fluid is supplied through the inlet 38A, fluid will initially flow into the low-pressure chamber 37A. For purposes of convenience, the low-pressure chamber 37A and components associated therewith may hereinafter be referred to as "the first chamber 37A." Such reference is similarly applicable to the fluid end 22 as a whole. For example, the low-pressure chamber 37B may be referred to as "the second chamber 37B," and the plunger 18C may be referred to as "the third plunger 18C."

Upon entering the first chamber 37A, one volume of fluid flows into the first plunger 18A via inlet ports 68A proximate to the inlet 38A through which fluid is supplied. This volume of fluid flows within the plunger 18A and along a path towards the suction valve 56A, as indicated by arrow 110A. A second volume of fluid similarly flows into the plunger 18A through inlets ports 68A proximate to the inlet 38A. Unlike the first volume of fluid, however, the second volume of fluid flows through and out of the plunger 18A via inlet ports 68A opposite the side of entry. As indicated by arrow 102, this volume of fluid flows out of the first chamber 37A and proceeds to flow into the second chamber 37B via inlet 38B.

Analogously, one volume of fluid flows into the second plunger 18B via inlet ports 68B, wherein the fluid flows along a path towards the suction valve 56B, as indicated by arrow 110B. A second volume of fluid flows through and out of the second plunger 18B and exits the second chamber 37B, as indicated by arrow 104. Fluid flowing out of the second chamber 37B proceeds to flow into the third chamber 37C via inlet 38C. The flow of fluid flowing into and out of the third plunger 18C is substantially similar to the flow of fluid flowing into and out of the first and second plungers 18A and 18B. As such, the low-pressure chambers 37A, 37B, and 38C and the respective plungers 18A, 18B, and 18C are in fluid communication such that fluid flows through and fills the various chambers and flow paths associated therewith while the plungers reciprocate within the chambers.

In one aspect, the fluid end 22 may be configured such that fluid flowing into and out of the third plunger 18C continues to flow out of the third chamber 37. For instance, an outlet 38D through which fluid may flow (indicated by arrow 106) may be formed at a second or opposite end of the cylindrical portion 42. In addition, fluid flowing out of the third chamber 37C through the outlet 38D may be re-circulated (e.g., via return conduits in fluid communication with the outlet 38D and the inlet 38A). Additionally or alternatively, the outlet 38D may be fluidly connected to a collection point such as a sump, which may be configured to collect fluids flowing out of the outlet 38D, or another cylinder bank and/or pump.

Figure 5B:
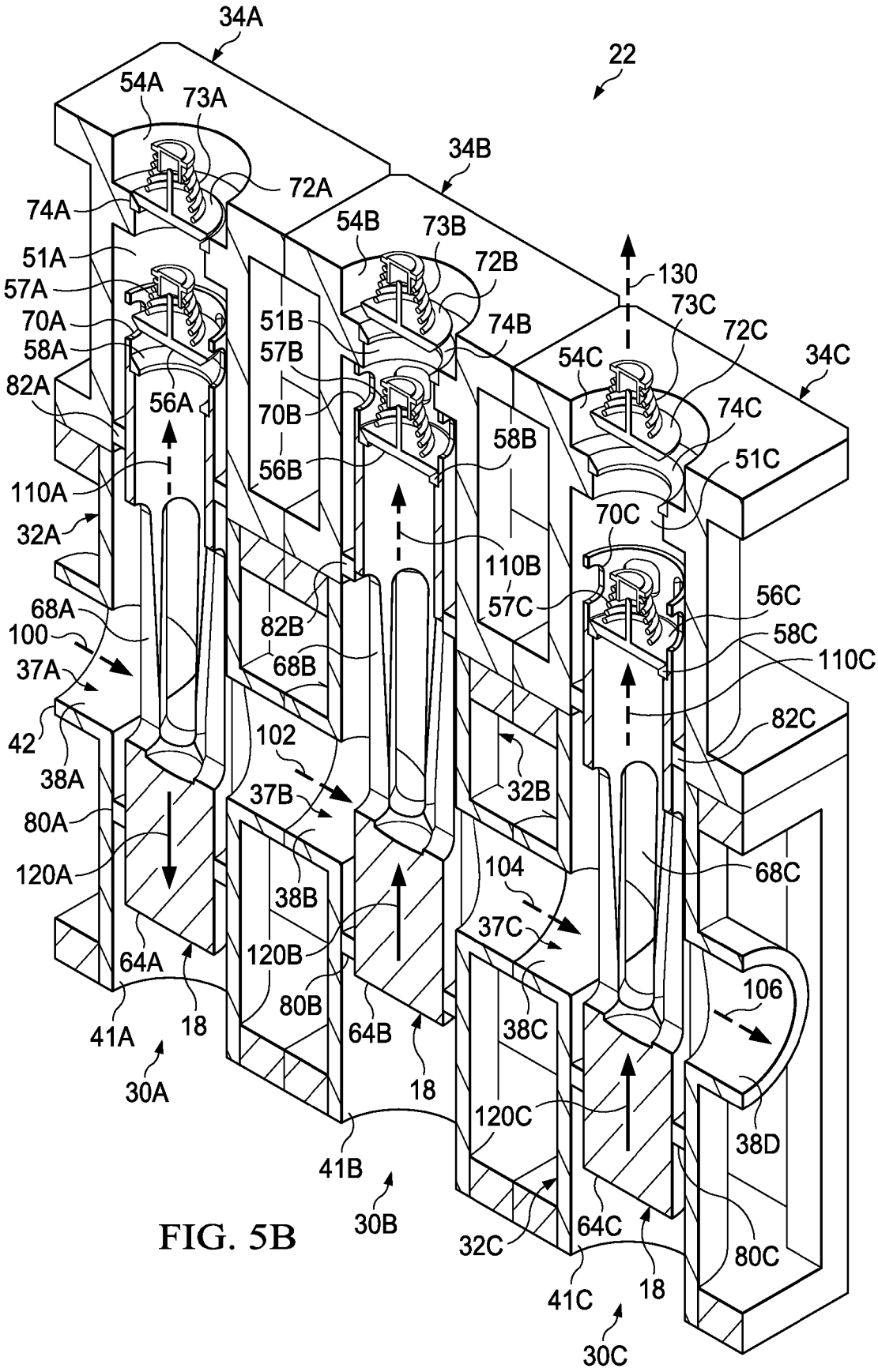
FIG. 5B is a cross-sectional view of the fluid end depicted in FIG. 5A.

In FIG. 5B, the plungers 18A, 18B, and 18C each reciprocate to perform forward and return strokes as described above with respect to FIG. 4A. For instance, the first plunger 18A is shown as completing a return stroke, in which the plunger 18A retracts away from the discharge valve 72A, as indicated by arrow 120A. During the return stroke, the discharge valve 72A closes and the suction valve 56A opens to draw fluid within the plunger 18A into the high-pressure chamber 51A. The opening of the suction valve 56A allows fluid to flow out of the plunger 18A through the outlet ports 70A and into the high-pressure chamber 51A. Accordingly, retraction of the plunger 18A during a return stroke results in a displacement of a volume of fluid (e.g., stroke volume minus plunger volume) within the plunger 18A.

Upon completing a return stroke, a plunger will proceed to perform a forward stroke, in which case a plunger (e.g., plungers 18B and 18C) extends towards a discharge valve, as indicated by arrows 110B and 110C. In FIG. 5B, the third plunger 18C is shown in a position corresponding to the start of a forward stroke, and the second plunger 18B is shown in a position corresponding to the end of a forward stroke. For convenience, an example of a forward stroke will be described generally with respect to the second plunger 18B, although it is to be understood that all three plungers 18A, 18B, and 18C perform forward and returns strokes similarly.

During a forward stroke, a suction valve 56B closes and a discharge valve 72B opens to discharge fluid via outlet 54B, as indicated by arrow 130 at outlet 54C. Despite the suction valve 56B being closed, fluid continues to flow into the plunger 18B via inlets 68B. Moreover, fluid within the plunger 18B flows along a path towards the suction valve 56B, as indicated by arrow 110B. Hence, fluid within the plunger 18B flows towards the suction valve 56B with a positive velocity. The positive or forward fluid flow within the plunger 18B is facilitated by the forward reciprocation of the plunger 18B, as the plunger 18B pushes fluid in the direction towards the suction valve 56B. Therefore, when the plunger 18B reaches its maximum forward stroke position and stops, the velocity of the fluid acts to force the suction valve 56B open as the plunger 18B begins to retract during a subsequent return stroke.

In an embodiment, the plungers 18A, 18B, and 18C may be angularly offset to ensure that no two plungers are located at the same position along their respective stroke paths (i.e., the plungers are "out of phase"). For example, the plungers 18A, 18B, and 18C may be angularly distributed to have a certain offset (e.g., 120 degrees of separation) to minimize undesirable effects that may result from multiple plungers of a single pump simultaneously producing pressure pulses. The position of a plunger is generally based on the number of degrees a pump crankshaft (e.g., crankshaft 16) has rotated from a bottom dead center (BDC) position. The BDC position corresponds to the position of a fully retracted plunger at zero velocity, e.g., just prior to a plunger moving forward in its cylinder.

As described above, each plunger 18A, 18B, and 18C is operable to draw in fluid during a forward stroke and a return stroke. Skilled artisans will understand that the plungers 18A, 18B, and 18C may be angularly offset or phase-shifted to improve fluid intake for each plunger 18A, 18B, and 18C. For instance, a phase degree offset (at 360 degrees divided by the number of plungers) may be employed to ensure the three plungers 18A, 18B, and 18C receive fluid and/or a certain quantity of fluid at all times of operation. In one implementation, the plungers 18A, 18B, and 18C may be phase-shifted by a 120-degree offset. Accordingly, when one plunger is at its maximum forward stroke position, a second plunger will be 60 degrees through its compression stroke from BDC, and a third plunger will be 120 degrees through its suction stroke from top dead center (TDC).

Those of ordinary skill in the art will readily appreciate various benefits that may be realized by the present disclosure. For instance, many pump designs require cross-bores that intersect high-pressure cylinders in the fluid ends of pumps. Such intersecting cross-bores create stress-concentrations that can render pumps susceptible to fatigue failure and limit the maximum pressure in which pumps can tolerate. The fluid end 22 disclosed herein overcomes such issues by removing the cross-bores commonly present in the high-pressure side of pumps. Since the high-pressure body 34 of the fluid end 22 does not include a cross-bore, the fluid end 22 may avoid high-stress points created around the high-pressure side. Accordingly, various mechanical failures (e.g., breaks, fractures, etc.) can be minimized and/or prevented, Additionally, by employing a substantially straight cylindrical body, high pressures within the high-pressure body 34 may be further contained by pre-stressing multi-layered cylindrical walls and heat shrinking (e.g., dual- or triple-layered concentric cylinders). Moreover, the fluid end 22 may be configured to be generally axis-symmetric, which may reduce overall weight since such a configuration allows for the use of relatively light materials. In contrast, for example, fluid ends with cross-bores at the high-pressure side commonly require heavy structures to provide sufficient fatigue strength for handling high-pressure stresses.

The implementation of a straight cylindrical body also helps prevent problems associated with proppants settling within fluid ends (e.g., in suction headers). Proppants, which may settle naturally (possibly due to transitional startups or shut-downs of the pump), typically flow through one or more cylinders within the high-pressure side of a fluid end at right or transverse angles. Since proppants tend to settle at corners where cylinders intersect, pump failure may result from undue accumulation. The fluid end 22 of the present disclosure, however, overcomes such issues by providing a linear flow path in which the plunger 18 urges proppants straight through the fluid end 22. Thus, the fluid end 22 poses no risk of accumulations resulting from high-pressure proppants flowing past sharp corners.

In addition, by movably disposing the suction valve 56 within the plunger 18, a relatively low spring force (e.g., a softer and/or lighter spring 57) may be employed for compressing the suction valve 56 and preventing valve float. For instance, due to the inertia of the suction valve 56 when it closes during a forward (or discharge) stroke, the suction valve 56 is urged against its seat 58 such that the valve 56 and the plunger 18 move relative to each other, which helps keep the suction valve 56 in sealing engagement with the seat 58.

Moreover, the forward momentum of fluid flowing within the plunger 18 during a forward stroke creates a natural water-hammer effect that aids in opening the suction valve 56 when the plunger 18 reaches its maximum stroke position and stops. For example, fluid may flow towards the suction valve 56 at high velocities such that the flow of fluid applies a force against the suction valve 56 that allows it to open more quickly and/or fully. Accordingly, the inertia of the suction valve 56 during the forward stroke, combined with the momentum of fluid flowing within the plunger 18 towards the suction valve 56, help keep the suction valve 56 closed during the forward stroke, while generating an additional opening force upon the forward stroke ending.

Furthermore, a well-balanced fluid system may be achieved by enabling the fluid end 22 to draw in fluid during both reciprocating strokes of a plunger 18. For instance, the fluid end 22 may be configured draw in one volume of fluid during a first stroke and a second volume of fluid during a second stroke, where each volume may be generally equal. As such, polar cavitation issues may be minimized. Moreover, the water-hammer effect described above also helps reduce cavitation, which often occurs if a valve opens too slowly so that high fluid velocity through the valve reduces the fluid pressure and forms a gas pocket in the chamber. The reduction and/or prevention of cavitation can significantly increase the overall efficiency and lifespan of pumps, as cavitation may result in permanent damage to the pump structure, as well as accelerated wear and deterioration of pump internal surfaces and seals.

Figure 6:
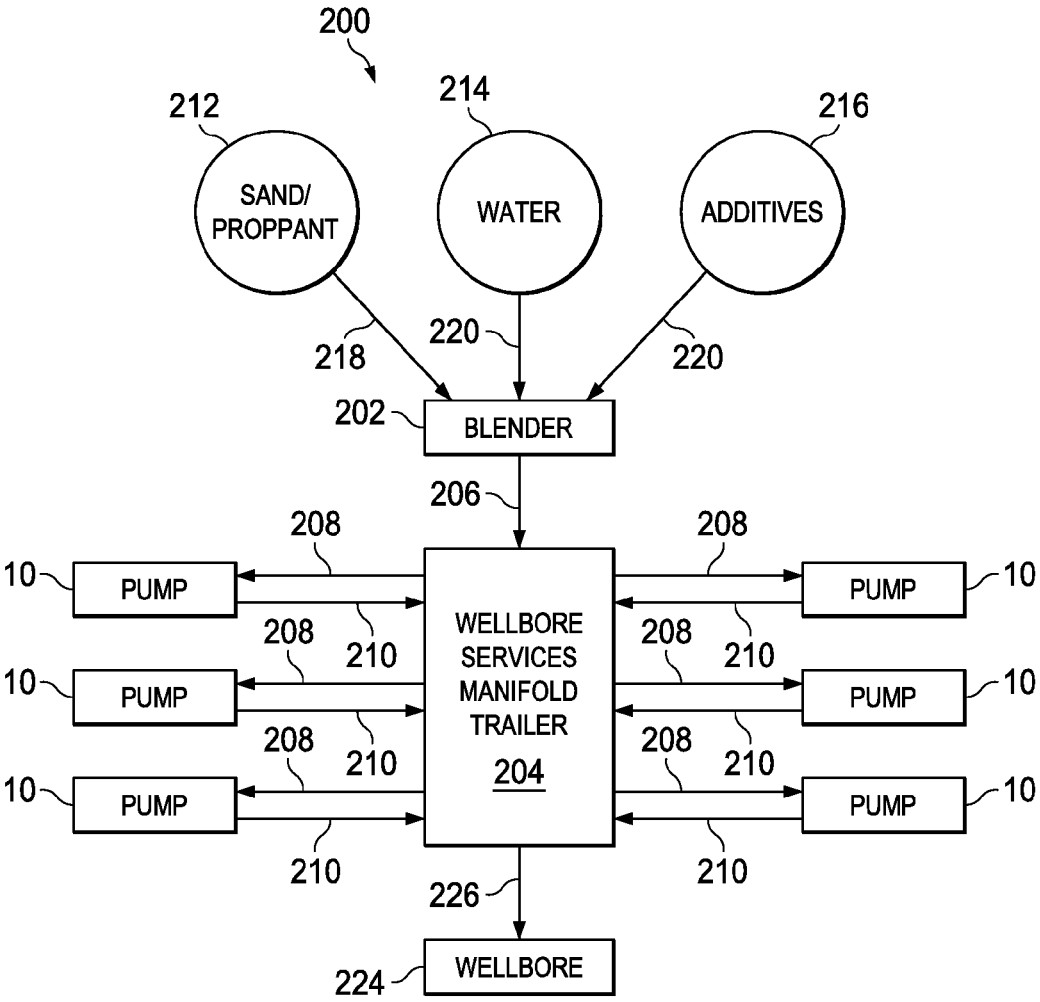
FIG. 6 is a schematic representation of an embodiment of a wellbore servicing system.

Referring to FIG. 6, an embodiment of a wellbore servicing system 200 will now be described. It will be appreciated that the wellbore servicing system 200 disclosed herein can be used for any purpose. In an embodiment, the wellbore servicing system 200 may be used to service a wellbore that penetrates a subterranean formation by pumping a wellbore servicing fluid into the wellbore and/or subterranean formation. As used herein, a "servicing fluid" refers to a fluid used to drill, complete, work over, fracture, repair, or in any way prepare a well bore for the recovery of materials residing in a subterranean formation penetrated by the well bore. It is to be understood that "subterranean formation" encompasses both areas below exposed earth and areas below earth covered by water such as ocean or fresh water. Examples of servicing fluids include, but are not limited to, cement slurries, drilling fluids or muds, spacer fluids, fracturing fluids or completion fluids, and gravel pack fluids, etc.

In an embodiment, the wellbore servicing system 200 comprises one or more pumps 10 operable to perform oilfield and/or well servicing operations. Such operations may include, but are not limited to, drilling operations, fracturing operations, perforating operations, fluid loss operations, primary cementing operations, secondary or remedial cementing operations, or any combination of operations thereof. Although a wellbore servicing system is illustrated, skilled artisans will readily appreciate that the pump 10 disclosed herein may be employed in any suitable operation.

In an embodiment, the wellbore servicing system 200 may be a system such a fracturing spread for fracturing wells in a hydrocarbon-containing reservoir. In fracturing operations, wellbore servicing fluids, such as particle laden fluids, are pumped at high-pressure into a wellbore. The particle laden fluids may then be introduced into a portion of a subterranean formation at a sufficient pressure and velocity to cut a casing and/or create perforation tunnels and fractures within the subterranean formation. Proppants, such as grains of sand, are mixed with the wellbore servicing fluid to keep the fractures open so that hydrocarbons may be produced from the subterranean formation and flow into the wellbore. Hydraulic fracturing may desirably create high-conductivity fluid communication between the wellbore and the subterranean formation.

The wellbore servicing system 200 comprises a blender 202 that is coupled to a wellbore services manifold trailer 204 via flowline 206. As used herein, the term "wellbore services manifold trailer" includes a truck and/or trailer comprising one or more manifolds for receiving, organizing, and/or distributing wellbore servicing fluids during wellbore servicing operations. In this embodiment, the wellbore services manifold trailer 204 is coupled to six positive displacement pumps (e.g., such as pump 10) via outlet flowlines 208 and inlet flowlines 210. In alternative embodiments, however, there may be more or less pumps used in a wellbore servicing operation. Outlet flowlines 208 are outlet lines from the wellbore services manifold trailer 204 that supply fluid to the pumps 10. Inlet flowlines 210 are inlet lines from the pumps 10 that supply fluid to the wellbore services manifold trailer 204.

The blender 202 mixes solid and fluid components to achieve a well-blended wellbore servicing fluid. As depicted, sand or proppant 212, water 214, and additives 216 are fed into the blender 202 via feedlines 218, 220, and 212, respectively. The water 214 may be potable, non-potable, untreated, partially treated, or treated water. In an embodiment, the water 214 may be produced water that has been extracted from the wellbore while producing hydrocarbons form the wellbore. The produced water may comprise dissolved and/or entrained organic materials, salts, minerals, paraffins, aromatics, resins, asphaltenes, and/or other natural or synthetic constituents that are displaced from a hydrocarbon formation during the production of the hydrocarbons. In an embodiment, the water 214 may be flowback water that has previously been introduced into the wellbore during wellbore servicing operation. The flowback water may comprise some hydrocarbons, gelling agents, friction reducers, surfactants and/or remnants of wellbore servicing fluids previously introduced into the wellbore during wellbore servicing operations.

The water 214 may further comprise local surface water contained in natural and/or manmade water features (such as ditches, ponds, rivers, lakes, oceans, etc.). Still further, the water 214 may comprise water stored in local or remote containers. The water 214 may be water that originated from near the wellbore and/or may be water that has been transported to an area near the wellbore from any distance. In some embodiments, the water 214 may comprise any combination of produced water, flowback water, local surface water, and/or container stored water. In some implementations, water may be substituted by nitrogen or carbon dioxide; some in a foaming condition.

In an embodiment, the blender 202 may be an Advanced Dry Polymer (ADP) blender and the additives 216 are dry blended and dry fed into the blender 202. In alternative embodiments, however, additives may be pre-blended with water using other suitable blenders, such as, but not limited to, a GEL PRO blender, which is a commercially available pre-blender trailer from Halliburton Energy Services, Inc., to form a liquid gel concentrate that may be fed into the blender 202. The mixing conditions of the blender 202, including time period, agitation method, pressure, and temperature of the blender 202, may be chosen by one of ordinary skill in the art with the aid of this disclosure to produce a homogeneous blend having a desirable composition, density, and viscosity. In alternative embodiments, however, sand or proppant, water, and additives may be premixed and/or stored in a storage tank before entering a wellbore services manifold trailer 204.

In an embodiment, the pumps 10 pressurize the wellbore servicing fluid to a pressure suitable for delivery into a wellbore 224 or wellhead. For example, the pumps 10 may increase the pressure of the wellbore servicing fluid to a pressure of up to about 20,000 psi, or about 30,000 psi, or higher. From the pumps 10, the wellbore servicing fluid may reenter the wellbore services manifold trailer 204 via inlet flowlines 210 and be combined so that the wellbore servicing fluid may have a total fluid flow rate that exits from the wellbore services manifold trailer 204 through flowline 226 to the flow connector wellbore 1128 of between about 1 BPM to about 200 BPM, alternatively from between about 50 BPM to about 150 BPM, alternatively about 100 BPM. Persons of ordinary skill in the art with the aid of this disclosure will appreciate that the flowlines described herein are piping that are connected together for example via flanges, collars, welds, etc. These flowlines may include various configurations of pipe tees, elbows, and the like. These flowlines connect together the various wellbore servicing fluid process equipment described herein.

Also disclosed herein are methods for servicing a wellbore (e.g., wellbore 224). Without limitation, servicing the wellbore may include: positioning the wellbore servicing composition in the wellbore (e.g., via one or more pumps 10 as described herein) to isolate the subterranean formation from a portion of the wellbore; to support a conduit in the wellbore; to plug a void or crack in the conduit; to plug a void or crack in a cement sheath disposed in an annulus of the wellbore; to plug a perforation; to plug an opening between the cement sheath and the conduit; to prevent the loss of aqueous or nonaqueous drilling fluids into loss circulation zones such as a void, vugular zone, or fracture; to plug a well for abandonment purposes; to divert treatment fluids; and/or to seal an annulus between the wellbore and an expandable pipe or pipe string. In another embodiment, the wellbore servicing systems and methods may be employed in well completion operations such as primary and secondary cementing operation to isolate the subterranean formation from a different portion of the wellbore.

In an embodiment, a wellbore servicing method may comprise transporting a positive displacement pump (e.g., pump 10) to a site for performing a servicing operation. Additionally or alternatively, one or more pumps may be situated on a suitable structural support. Non-limiting examples of a suitable structural support or supports include a trailer, truck, skid, barge or combinations thereof. In an embodiment, a motor or other power source for a pump may be situated on a common structural support.

In an embodiment, a wellbore servicing method may comprise providing a source for a wellbore servicing fluid. As described above, the wellbore servicing fluid may comprise any suitable fluid or combinations of fluid as may be appropriate based upon the servicing operation being performed. Non-limiting examples of suitable wellbore servicing fluid include a fracturing fluid (e.g., a particle laden fluid, as described herein), a perforating fluid, a cementitious fluid, a sealant, a remedial fluid, a drilling fluid (e.g., mud), a spacer fluid, a gelation fluid, a polymeric fluid, an aqueous fluid, an oleaginous fluid, an emulsion, various other wellbore servicing fluid as will be appreciated by one of skill in the art with the aid of this disclosure, and combinations thereof. The wellbore servicing fluid may be prepared on-site (e.g., via the operation of one or more blenders) or, alternatively, transported to the site of the servicing operation.

In an embodiment, a wellbore servicing method may comprise fluidly coupling a pump 10 to the wellbore servicing fluid source. As such, wellbore servicing fluid may be drawn into and emitted from the pump 10. Additionally or alternatively, a portion of a wellbore servicing fluid placed in a wellbore 224 may be recycled, i.e., mixed with the water stream obtained from a water source and treated in fluid treatment system. Furthermore, a wellbore servicing method may comprise conveying the wellbore servicing fluid from its source to the wellbore via the operation of the pump 10 disclosed herein.

In an alternative embodiment, the reciprocating apparatus may comprise a compressor. In an embodiment, a compressor similar to the pump 10 may comprise at least one each of a cylinder, plunger, connecting rod, crankshaft, and housing, and may be coupled to a motor. In an embodiment, such a compressor may be similar in form to a pump and may be configured to compress a compressible fluid (e.g., a gas) and thereby increase the pressure of the compressible fluid. For example, a compressor may be configured to direct the discharge therefrom to a chamber or vessel that collects the compressible fluid from the discharge of the compressor until a predetermined pressure is built up in the chamber. Generally, a pressure sensing device may be arranged and configured to monitor the pressure as it builds up in the chamber and to interact with the compressor when a predetermined pressure is reached. At that point, the compressor may either be shut off, or alternatively the discharge may be directed to another chamber for continued operation.

In an embodiment, a reciprocating apparatus comprises an internal combustion engine, hereinafter referred to as an engine. Such engines are also well known, and typically include at least one each of a plunger, cylinder, connecting rod, and crankshaft. The arrangement of these components is substantially the same in an engine and a pump (e.g. pump 10). A reciprocating element such as a plunger 18 may be similarly arranged to move in reciprocating fashion within the cylinder. Skilled artisans will appreciate that operation of an engine may somewhat differ from that of a pump. In a pump, rotational power is generally applied to a crankshaft acting on the plunger via the connecting rod, whereas in an engine, rotational power generally results from a force (e.g., an internal combustion) exerted on or against the plunger, which acts against the crankshaft via the connecting rod.

For example, in a typical 4-stroke engine, arbitrarily beginning with the exhaust stroke, the plunger is fully extended during the exhaust stroke, (e.g., minimizing the internal volume of the cylinder). The plunger may then be retracted by inertia or other forces of the engine componentry during the intake stroke. As the plunger retracts within the cylinder, the internal volume of cylinder increases, creating a low pressure within the cylinder into which an air/fuel mixture is drawn. When the plunger is fully retracted within the cylinder, the intake stroke is complete, and the cylinder is substantially filled with the air/fuel mixture. As the crankshaft continues to rotate, the plunger may then be extended, during the compression stroke, into the cylinder compressing the air-fuel mixture within the cylinder to a higher pressure.

A spark plug may be provided to ignite the fuel at a predetermined point in the compression stroke. This ignition increases the temperature and pressure within the cylinder substantially and rapidly. In a diesel engine, however, the spark plug may be omitted, as the heat of compression derived from the high compression ratios associated with diesel engines suffices to provide spontaneous combustion of the air-fuel mixture. In either case, the heat and pressure act forcibly against the plunger and cause it to retract back into the cylinder during the power cycle at a substantial force, which may then be exerted on the connecting rod, and thereby on to the crankshaft.

ADDITIONAL DISCLOSURE

The following are non-limiting, specific embodiments in accordance with the present disclosure:

Embodiment A

A high-pressure pump comprising:

a fluid end comprising at least one fluid inlet through which fluid flows into at least one intake chamber within the fluid end;

a plunger disposed within the at least one chamber, the plunger comprising a peripheral wall defining a hollow body, the peripheral wall including at least one inlet port through which fluid within the intake chamber flows through the intake chamber; and a power end operatively connected to the plunger and operable to reciprocate the plunger along a path within the intake chamber in alternate directions, wherein fluid continuously flows through the intake chamber as the plunger reciprocates.

Embodiment B

The high-pressure pump of Embodiment A, further comprising:

a suction valve disposed within the hollow body of the plunger, wherein the suction valve is operable to control fluid flow from the hollow body through an outlet of the plunger and into a discharge chamber within the fluid end; and a discharge valve disposed within the discharge chamber, the discharge valve being operable to control fluid flow out of the discharge chamber through a discharge outlet associated therewith, wherein, as the plunger retracts away from the discharge valve, the suction valve opens to allow fluid to flow into the discharge chamber through the outlet of the plunger and the discharge valve closes to prevent fluid from flowing out of the discharge chamber through the discharge outlet, and as the plunger extends towards the discharge valve, the suction valve closes to prevent fluid from flowing into the discharge chamber through outlet of the plunger and the discharge valve opens to allow fluid to flow out of the discharge chamber through the discharge outlet.

Embodiment C

The high-pressure pump of Embodiment B, wherein the outlet of the plunger comprises a plurality of outlet ports integrally formed within the peripheral wall and circumferentially arranged around a head portion of the hollow body, and wherein the at least one inlet port comprises a plurality of inlet ports circumferentially arranged around a central portion of the hollow body.

Embodiment D

The high-pressure pump of embodiment C, wherein the high-pressure pump is configured to operate at a pressure greater than or equal to about 3,000 psi and/or in a well servicing operation and environment.

Embodiment E

The high-pressure pump of any preceding Embodiment(s), wherein the plurality of inlet ports extend axially along the peripheral wall in a direction substantially parallel to the path in which the plunger reciprocates, and wherein the plurality of outlet ports each define a central axis being substantially perpendicular to the path of reciprocation.

Embodiment F

The high-pressure pump of any preceding Embodiment(s), wherein the head portion of the hollow body defines a plunger head formed at a front end of the plunger, the plunger head including a hollow passageway in which the suction valve moves within the plunger to permit or prevent fluid flow through the plurality of outlet ports.

Embodiment G

The high-pressure pump of any preceding Embodiment(s), wherein the hollow body extends from a solid plunger base to the front end of the plunger, the solid plunger base being disposed within the intake chamber and the plunger head being disposed within the discharge chamber.

Embodiment H

The high-pressure pump of any preceding Embodiment(s), wherein the fluid end comprises at least one assembly including an open-ended low-pressure cylinder and an open-ended high-pressure cylindrical body, the low-pressure cylinder defining the intake chamber and the high-pressure cylindrical body defining the discharge chamber, and wherein the low-pressure cylinder is attached to and coaxially aligned with the high-pressure cylindrical body, and wherein the high-pressure cylindrical body does not include an intersecting cross-bore.

Embodiment I

The high-pressure pump of any preceding Embodiment(s), wherein at least one of the low-pressure cylinder and the high-pressure cylindrical body comprises a plurality of concentric cylinders, wherein an outer cylinder pre-loads an inner cylinder.

Embodiment J

The high-pressure pump of any preceding Embodiment(s), wherein the at least one of the low-pressure cylinder and the high-pressure cylindrical body further comprises at least one composite overwrap surrounding an exterior wall thereof.

Embodiment K

The high-pressure pump of any preceding Embodiment(s), wherein the low-pressure cylinder includes a sidewall having an opening for receiving fluid and an open end through which fluid flows from the low-pressure cylinder and into the high-pressure cylindrical body, and the high-pressure cylindrical body includes an open end defining the discharge outlet, wherein fluid is discharged through the discharge outlet along a substantially linear axis, and wherein fluid flows through the opening and into the low-pressure cylinder along an axis transverse to the linear axis.

Embodiment L

The high-pressure pump of any preceding Embodiment(s), wherein the at least one assembly comprises a plurality of assemblies configured substantially identically and arranged in parallel to each other, and wherein fluid within each corresponding low-pressure cylinder flows into and flows out of each corresponding high-pressure cylindrical body in a uniform direction.

Embodiment M

The high-pressure pump of any preceding Embodiment(s), further comprising:

a cylindrical portion interconnecting each low-pressure cylinder of the plurality of assemblies and defining a common passageway extending therethrough, the cylindrical portion including multiple inlets and outlets through which fluid flowing along the common passageway continually flows into and/or out of each low-pressure cylinder, wherein fluid flowing into and/or out of each low-pressure cylinder further flows into and/or through the hollow body of each corresponding plunger via the plurality of inlet ports thereof.

Embodiment N

The high-pressure pump of any preceding Embodiment(s), wherein the common passageway extends through each low-pressure cylinder along an axis transverse to a central axis of each low-pressure cylinder.

Embodiment O

The high-pressure pump of any preceding Embodiment(s), wherein a section defining a shaft extends from the solid plunger base to a tail end that is opposite of the front end of the plunger, the shaft having a smaller diameter than the solid plunger base, and wherein the smaller diameter of the shaft allows fluid to continuously flow into the hollow body as the plunger reciprocates in alternate directions.

Embodiment P

The high-pressure pump of any preceding Embodiment(s), wherein the plurality of assemblies comprise three pump body assemblies including three corresponding plungers, the three plungers being angularly offset by about 120 degrees.

Embodiment Q

The high-pressure pump of any preceding Embodiment(s), further comprising:

an external manifold in fluid communication with the plurality of assemblies, wherein the external manifold includes one or more fluid conduits fluidly connected to each low-pressure cylinder and operable to supply fluid thereto, respectively.

Embodiment R

The high-pressure pump of any preceding Embodiment(s), wherein the suction valve is coaxial with the discharge valve.

Embodiment S

A system for servicing a wellbore with at least one reciprocating pump having a plurality of plungers driven through a forward stroke and a return stroke by a common crankshaft, each plunger disposed within an intake chamber and a discharge chamber having a suction valve and a discharge valve, respectively, the system comprising:

a source of a wellbore servicing fluid;

at least one pump body assembly comprising:

at least one fluid inlet through which fluid flows into each intake chamber associated with the plurality of plungers, each plunger comprising a peripheral wall defining a hollow body in which the suction valve is disposed, the peripheral wall including at least one inlet port through which fluid flows into the hollow body; and a discharge outlet through which fluid is discharged out of the discharge chamber and into the wellbore during forward strokes; and a wellbore, wherein the wellbore servicing fluid is communicated from the source into the wellbore via the at least one reciprocating pump.

Embodiment T

The system of Embodiment S, wherein the suction valve opens and the discharge valve closes as a corresponding plunger retracts away from the discharge valve to displace fluid through at least one outlet port of the plunger, and wherein the suction valve closes and the discharge valve opens as the plunger extends towards the discharge valve to discharge fluid through the discharge outlet.

Embodiment U

The system of Embodiment T, wherein the at least one outlet port comprises a plurality of outlet ports integrally formed within the peripheral wall and circumferentially arranged around a head portion of the hollow body, and wherein the at least one inlet port comprises a plurality of inlet ports circumferentially arranged around a central portion of the hollow body.

Embodiment V

The system of Embodiment S, T, and/or U, wherein the head portion of the hollow body defines a plunger head formed at a front end of the plunger, the plunger head including a hollow passageway in which the suction valve moves within the plunger to permit or prevent fluid flow through the plurality of outlet ports, and wherein the hollow body extends from a solid plunger base to the front end of the plunger, the solid plunger base being disposed within the intake chamber and the plunger head being disposed within the discharge chamber.

Embodiment W

The system of at least one of Embodiments S-V, further comprising:

a wellbore services manifold trailer in fluid communication with the at least one reciprocating pump, the wellbore services manifold trailer fluidly connecting each reciprocating pump selected from the at least one reciprocating pump to the wellbore, wherein the at least one reciprocating pump comprises a first reciprocating pump, a second reciprocating pump, and a third reciprocating pump configured substantially the same as each reciprocating pump selected from the at least one reciprocating pump; and a blender in fluid communication with the wellbore services manifold trailer, wherein at least one of the first reciprocating pump, the second reciprocating pump, and the third reciprocating pump receive the wellbore servicing fluid from the blender via the wellbore services manifold trailer.

Embodiment X

The system at least one of Embodiments S-W, wherein the wellbore servicing fluid is at least one fluid selected from the group consisting of: a fracturing fluid, a cementitious fluid, a remedial fluid, a perforating fluid, a sealant, a drilling fluid, a spacer fluid, a gelation fluid, a polymeric fluid, an aqueous fluid, and an oleaginous fluid.

Embodiment Y

A method of servicing a wellbore with at least one reciprocating pump having a plurality of plungers driven through a forward stroke and a return stroke by a common crankshaft, each plunger disposed within an intake chamber and a discharge chamber having a suction valve and a discharge valve, respectively, the method comprising:

providing a source of a wellbore servicing fluid at the wellbore;

transporting the reciprocating pump to the wellbore, the reciprocating pump comprising:

at least one fluid inlet through which fluid flows into each intake chamber associated with the multiple plungers, each plunger comprising a peripheral wall defining a hollow body in which the suction valve is disposed, the peripheral wall including at least one inlet port through which fluid flows into the hollow body, and each plunger including at least one outlet port through which fluid from the hollow body flows into the discharge chamber during return strokes; and a discharge outlet through which fluid flows out of the discharge chamber and into the wellbore during forward strokes;

fluidly coupling the reciprocating pump to the source of the wellbore servicing fluid and to the wellbore; and communicating wellbore servicing fluid into the wellbore via the reciprocating pump, wherein wellbore servicing fluid flows in and out of each discharge chamber along a common axis, respectively, the common axis being parallel to a path in which each corresponding plunger is driven during forward strokes and return strokes.

Embodiment Z

The method of Embodiment Y, wherein the suction valve within each intake chamber opens and the discharge valve within each discharge chamber closes as a corresponding plunger retracts away from the discharge valve to displace wellbore servicing fluid, and wherein the suction valve closes and the discharge valve opens as the plunger extends towards the discharge valve to discharge wellbore servicing fluid.

Embodiment Z1

The method of Embodiment(s) Y and/or Z, wherein an inertial force of the suction valve acts against a force of fluid applied to the suction valve as the plunger extends to discharge wellbore servicing fluid when the suction valve is closed, and wherein the inertial force of the suction valve aids in opening the suction valve upon completion of a forward stroke.

Embodiment Z2

The method of at least one of Embodiment(s) Y-Z1, further comprising:

continuously supplying wellbore servicing fluid along a common passageway interconnecting each intake chamber, each intake chamber being substantially parallel to one another, wherein wellbore servicing fluid flowing into and/or out of each intake chamber continually flows into and/or through the hollow body of each corresponding plunger via the at least one inlet port.

Embodiment Z3

The method of at least one of Embodiment Y-Z2, wherein a substantially equal volume of fluid flows from a hollow body and into a corresponding discharge chamber during the forward stroke and during the return stroke.

Embodiment Z4

The method of at least one of Embodiment Y-Z3, wherein the wellbore servicing fluid is at least one fluid selected from the group consisting of: a fracturing fluid, a cementitious fluid, a remedial fluid, a perforating fluid, a sealant, a drilling fluid, a spacer fluid, a gelation fluid, a polymeric fluid, an aqueous fluid, and an oleaginous fluid.

Embodiment Z5

Any one or more of the preceding embodiments, wherein the high-pressure pump and/or the at least one reciprocating pump further comprises a cylindrical high-pressure outer body that does not include a crossing bore.

Embodiment Z6

The Embodiment of Z5, wherein the discharge chamber is disposed within the cylindrical high-pressure outer body.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: $R=R1+k*(Ru-R1)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference herein is not an admission that it is prior art to the present invention, especially any reference that may have a publication date after the priority date of this application. The disclosures of all patents, patent applications, and publications cited herein are hereby incorporated by reference, to the extent that they provide exemplary, procedural, or other details supplementary to those set forth herein.

We claim:

1. A high-pressure pump comprising:

a fluid end comprising at least one fluid inlet through which fluid flows into at least one intake chamber within the fluid end;

a plunger disposed within the at least one chamber, the plunger comprising a peripheral wall defining a hollow body, the peripheral wall including at least one inlet port through which fluid within the intake chamber flows into the hollow body; and a power end operatively connected to the plunger and operable to reciprocate the plunger along a path within the intake chamber in alternate directions, wherein fluid continuously flows through the intake chamber as the plunger reciprocates, and wherein the high-pressure pump is configured to operate at a pressure greater than or equal to about 3,000 psi and/or in a well servicing operation and environment.

2. The high-pressure pump of claim 1, further comprising:

a suction valve disposed within the hollow body of the plunger, wherein the suction valve is operable to control fluid flow from the hollow body through an outlet of the plunger and into a discharge chamber within the fluid end; and a discharge valve disposed within the discharge chamber, the discharge valve being operable to control fluid flow out of the discharge chamber through a discharge outlet associated therewith, wherein, as the plunger retracts away from the discharge valve, the suction valve opens to allow fluid to flow into the discharge chamber through the outlet of the plunger and the discharge valve closes to prevent fluid from flowing out of the discharge chamber through the discharge outlet, and as the plunger extends towards the discharge valve, the suction valve closes to prevent fluid from flowing into the discharge chamber through the outlet of the plunger and the discharge valve opens to allow fluid to flow out of the discharge chamber through the discharge outlet.

3. The high-pressure pump of claim 2, wherein the outlet of the plunger comprises a plurality of outlet ports integrally formed within the peripheral wall and circumferentially arranged around a head portion of the hollow body, and wherein the at least one inlet port comprises a plurality of inlet ports circumferentially arranged around a central portion of the hollow body.

4. The high-pressure pump of claim 2, wherein the head portion of the hollow body defines a plunger head formed at a front end of the plunger, the plunger head including a hollow passageway in which the suction valve moves within the plunger to permit or prevent fluid flow through the plurality al outlet ports.

5. The high-pressure pump of claim 4, wherein the hollow body extends from a solid plunger base to the front end of the plunger, the solid plunger base being disposed within the intake chamber and the plunger head being disposed within the discharge chamber.

6. The high-pressure pump of claim 5, wherein the fluid end comprises at least one assembly including an open-ended low-pressure cylinder and an open-ended high-pressure cylindrical body, the low-pressure cylinder defining the intake chamber and the high-pressure cylindrical body defining the discharge chamber, wherein the low-pressure cylinder is attached to and coaxially aligned with the high-pressure cylindrical body, and wherein the high-pressure cylindrical body does not include an intersecting cross-bore.

7. The high-pressure pump of claim 6, wherein at least one of the low-pressure cylinder and the high-pressure cylindrical body comprises a plurality of concentric cylinders, wherein an outer cylinder pre-loads an inner cylinder.

8. The high-pressure pump of claim 7, wherein the at least one of the low-pressure cylinder and the high-pressure cylindrical body further comprises at least one composite overwrap surrounding an exterior wall thereof.

9. The high-pressure pump of claim 6, wherein the low-pressure cylinder includes a sidewall having an opening for receiving fluid and an open end through which fluid flows from the low-pressure cylinder and into the high-pressure cylindrical body, and the high-pressure cylindrical body includes an open end defining the discharge outlet, wherein fluid is discharged through the discharge outlet along a substantially linear axis, and wherein fluid flows through the opening and into the low-pressure cylinder along art axis transverse to the linear axis.

10. The high-pressure pump of claim 6, wherein the at least one assembly comprises a plurality of assemblies configured substantially identically and arranged in parallel to each other, and wherein fluid within each corresponding low-pressure cylinder flows into and flows out of each corresponding high-pressure cylindrical body in a uniform direction.

11. The high-pressure pump of claim 10, further comprising:

a cylindrical portion interconnecting each low-pressure cylinder of the plurality of assemblies and defining a common passageway extending therethrough, the cylindrical portion including multiple inlets and outlets through which fluid flowing along the common passageway continually flows into and/or out of each low-pressure cylinder, wherein fluid flowing into and/or out of each low-pressure cylinder further flows into and/or through the hollow body of each corresponding plunger via the plurality of inlet ports thereof.

12. The high-pressure pump of claim 11, wherein the common passageway extends through each low-pressure cylinder along an axis transverse to a central axis of each low-pressure cylinder.

13. The high-pressure pump of claim 5, wherein a section defining a shaft extends from the solid plunger base to a tail end that is opposite of the front end of the plunger, the shaft having a smaller diameter than the solid plunger base, and wherein the smaller diameter of the shaft allows fluid to continuously flow into the hollow body as the plunger reciprocates in alternate directions.

14. The high-pressure pump of claim 10, wherein the plurality of assemblies comprise three pump body assemblies including three corresponding plungers, the three plungers being angularly offset by about 120 degrees.

15. The high-pressure pump of claim 10, further comprising:

an external manifold in fluid communication with the plurality of assemblies, wherein the external manifold includes one or more fluid conduits fluidly connected to each low-pressure cylinder and operable to supply fluid thereto, respectively.

16. The high-pressure pump of claim 2, wherein the suction valve is coaxial with the discharge valve.

17. A system for servicing a wellbore with at least one reciprocating pump having a plurality of plungers driven through a forward stroke and a return stroke by a common crankshaft, each plunger disposed within an intake chamber and a discharge chamber having a suction valve and a discharge valve, respectively, the system comprising:

a source of a wellbore servicing fluid;

at least one pump body assembly comprising:

at least one fluid inlet through which fluid flows into each intake chamber associated with the plurality of plungers, each plunger comprising a peripheral wall defining a hollow body in which the suction valve is disposed, the peripheral wall including at least one inlet port through which fluid flows into the hollow body; and as discharge outlet through which fluid is discharged out of the discharge chamber and into the wellbore during forward strokes; and a wellbore, wherein the wellbore servicing fluid is communicated from the source into the wellbore via the at least one reciprocating pump.

18. A method of servicing a wellbore with at least one reciprocating pump having a plurality of plungers driven through a forward stroke and a return stroke by a common crankshaft, each plunger disposed within an intake chamber and a discharge chamber having a suction valve and a discharge valve, respectively, the method comprising;

providing a source of a wellbore servicing fluid at the wellbore;

transporting the at least one reciprocating pump to the wellbore, the at least one reciprocating pump comprising:

at least one fluid inlet through which fluid flows into each intake chamber associated with the multiple plungers, each plunger comprising a peripheral wall defining a hollow body in which the suction valve is disposed, the peripheral wall including at least one inlet port through which fluid flows into the hollow body, and each plunger including at least one outlet port through which fluid from the hollow body flows into the discharge chamber during return strokes; and a discharge outlet through which fluid flows out of the discharge chamber and into the wellbore during forward strokes;

fluidly coupling the at least one reciprocating pump to the source of the wellbore servicing fluid and to the wellbore; and communicating wellbore servicing fluid into the wellbore via the at least one reciprocating pump, wherein wellbore servicing fluid flows in and out of each discharge chamber along a common axis, respectively, the common axis being parallel to a path in which each corresponding plunger is driven during forward strokes and return strokes.

19. A high-pressure pump comprising:

a fluid end comprising at least one fluid inlet through which fluid flows into at least one intake chamber within the fluid end;

a plunger disposed within the at least one chamber, the plunger comprising a peripheral wall defining a hollow body, the peripheral wall including at least one inlet port through which fluid within the intake chamber flows into the hollow body;

a power end operatively connected to the plunger and operable to reciprocate the plunger along a path within the intake chamber in alternate directions, a suction valve disposed within the hollow body of the plunger, wherein the suction valve is operable to control fluid flow from the hollow body through an outlet of the plunger and into a discharge chamber within the fluid end; and a discharge valve disposed within the discharge chamber, the discharge valve being operable to control fluid flow out of the discharge chamber through a discharge outlet associated therewith, wherein fluid continuously flows through the intake chamber as the plunger reciprocates, wherein, as the plunger retracts away from the discharge valve, the suction valve opens to allow fluid to flow into the discharge chamber through the outlet of the plunger and the discharge valve closes to prevent fluid from flowing out of the discharge chamber through the discharge outlet, and as the plunger extends towards the discharge valve, the suction valve closes to prevent fluid from flowing into the discharge chamber through the outlet of the plunger and the discharge valve opens to allow fluid to flow out of the discharge chamber through the discharge outlet, wherein the outlet of the plunger comprises a plurality of outlet ports integrally formed within the peripheral wall and circumferentially arranged around a head portion of the hollow body, and wherein the at least one inlet port comprises a plurality of inlet ports circumferentially arranged around a central portion of the hollow body.

20. The high-pressure pump of claim 19, wherein the high-pressure pump is configured to operate at a pressure greater than or equal to about 3,000 psi and/or in a well servicing operation and environment.

21. The high-pressure pump of claim 19, wherein the plurality of it ports extend axially along the peripheral wall in a direction substantially parallel to the path in which the plunger reciprocates, and wherein the plurality of outlet ports each define a central axis being substantially perpendicular to the path of reciprocation.

22. A high-pressure pump comprising:

a fluid end comprising at least one fluid inlet through which fluid flows into at least one intake chamber within the fluid end;

a plunger disposed within the at least one chamber, the plunger comprising a peripheral wall defining a hollow body, the peripheral wall including at least one inlet port through which fluid within the intake chamber flows into the hollow body;

a power end operatively connected to the plunger and operable to reciprocate the plunger along a path within the intake chamber in alternate directions, a suction valve disposed within the hollow body of the plunger, wherein the suction valve is operable to control fluid flow from the hollow body through an outlet of the plunger and into a discharge chamber within the fluid end; and a discharge valve disposed within the discharge chamber, the discharge valve being operable to control fluid flow out of the discharge chamber through a discharge outlet associated therewith, wherein fluid continuously flows through the intake chamber as the plunger reciprocates, wherein, as the plunger retracts away from the discharge valve, the suction valve opens to allow fluid to flow into the discharge chamber through the outlet of the plunger and the discharge valve closes to prevent fluid from flowing out of the discharge chamber through the discharge outlet, and as the plunger extends towards the discharge valve, the suction valve closes to prevent fluid from flowing into the discharge chamber through the outlet of the plunger and the discharge valve opens to allow fluid to flow out of the discharge chamber through the discharge outlet, wherein the head portion of the hollow body defines a plunger head formed at a front end of the plunger, the plunger head including a hollow passageway in which the suction valve moves within the plunger to permit or prevent fluid flow through a plurality of outlet ports.

23. The high-pressure pump of claim 22, wherein the high-pressure pump is configured to operate at a pressure greater than or equal to about 3,000 psi and/or in a well servicing operation and environment.

* * * * *

UNITED STATES PATENT AND TRADEMARK OFFICE

CERTIFICATE OF CORRECTION

PATENT NO. : 8,590,614 B2
APPLICATION NO. : 13/099939
DATED : November 26, 2013
INVENTOR(S) : Jim B. Surjaatmadja et al.

It is certified that error appears in the above-identified patent and that said Letters Patent is hereby corrected as shown below:

In the Specification

In Column 6, line 53, replace “ore” with --or--.

In Column 15, line 61, replace “prevented,” with --prevented.--.

In the Claims

In Column 27, line 37, claim 4, replace “plurality al” with --plurality of--.

In Column 28, line 2, claim 9, replace “art axis” with --an axis--.

In Column 30, line 16, claim 21, replace “it ports” with --inlet ports--.

Signed and Sealed this
Fourth Day of February, 2014

Michelle K. Lee

Michelle K. Lee
*Deputy Director of the United States Patent and Trademark Office*